US012638283B2

(12) United States Patent
Teowee et al.

(10) Patent No.: US 12,638,283 B2
(45) Date of Patent: May 26, 2026

(54) COMMUNICATIONS IN ELECTRONIC DETONATORS

(71) Applicant: AUSTIN STAR DETONATOR COMPANY, Cleveland, OH (US)

(72) Inventors: Gimtong Teowee, Westlake Village, OH (US); Larry S. Howe, Norwalk, OH (US)

(73) Assignee: Austin Star Detonator Company, Cleveland, OH (US)

( * ) Notice: Subject to any disclaimer, the term of this patent is extended or adjusted under 35 U.S.C. 154(b) by 187 days.

(21) Appl. No.: 18/010,742

(22) PCT Filed: Jun. 25, 2021

(86) PCT No.: PCT/US2021/039111
§ 371 (c)(1),
(2) Date: Dec. 15, 2022

(87) PCT Pub. No.: WO2021/263116
PCT Pub. Date: Dec. 30, 2021

(65) Prior Publication Data

US 2023/0296364 A1 Sep. 21, 2023

Related U.S. Application Data

(60) Provisional application No. 63/045,076, filed on Jun. 27, 2020.

(51) Int. Cl.
*F42D 1/055* (2006.01)

(52) U.S. Cl.
CPC ..... *F42D 1/055* (2013.01)

(58) Field of Classification Search
CPC ..... F42D 1/055
See application file for complete search history.

(56) References Cited

U.S. PATENT DOCUMENTS

| | | | | |
|---|---|---|---|---|
| 2005/0103219 | A1 | 5/2005 | McClure et al. | |
| 2007/0095237 | A1 * | 5/2007 | Hallin | F42D 1/055 102/215 |
| 2009/0145321 | A1 * | 6/2009 | Russell | F42D 1/05 102/200 |
| 2020/0200516 | A1 * | 6/2020 | Zemla | F42D 1/045 |
| 2021/0318107 | A1 * | 10/2021 | Maurissens | F42D 3/04 |
| 2022/0018644 | A1 * | 1/2022 | Biard | F42D 1/055 |

FOREIGN PATENT DOCUMENTS

| | | | | |
|---|---|---|---|---|
| CN | 105698617 | A | 6/2016 | |
| WO | WO-2008078288 | A1 * | 7/2008 | F42D 1/055 |
| WO | 2020138783 | A1 | 7/2020 | |

* cited by examiner

*Primary Examiner* — Amine Benlagsir
(74) *Attorney, Agent, or Firm* — Lippes Mathias LLP

(57) ABSTRACT

A detonator blasting system includes a blasting machine or logger, at least one electronic detonator arranged in an array with electrical connection between them. An improved communications method results in faster communications throughout the blast process.

7 Claims, 19 Drawing Sheets

COMMUNICATIONS IN ELECTRONIC DETONATORS

The present application claims priority to, and the benefit of, U.S. Provisional Patent Application No. 63/045,076, filed Jun. 27, 2020 and entitled IMPROVED COMMUNICATIONS IN ELECTRONIC DETONATORS, the entirety of which is hereby incorporated by reference, and the present application is a national stage entry of PCT/US2021/039111, filed Jun. 25, 2021, the entirety of which is hereby incorporated by reference.

BACKGROUND

Blasting systems include apparatus to detonate explosive charges positioned in specific locations. Detonators and explosives are buried in the ground, for example, in holes (e.g., bore holes) drilled into rock formations, etc. The detonators are wired for external access to wired or wireless master controllers or blasting machines that provide electrical firing signaling to initiate detonation of the explosives. The blasting machine is wired to an array of detonators, and some blasting systems include a remotely located master controller and a local slave device connected to the blasting machine at the blast site. In wireless blasting systems, no wiring or lead lines are connected between the detonator array and the master controller, and the master controller can be positioned a significant distance from the blast site. A blast sequence may include power up, verification and/or programming of delay times, arming and issuance of a fire command. The blasting machine provides enough energy and voltage to charge firing capacitors in the detonators, and initiates the actual detonator firing in response to the fire command. During the firing phase, upon operator input at the master controller, a fire command is transferred from the master to the slave which then issues the final command to the blasting machine in order to fire the detonators.

Each detonator has global unique number, referred to as a serial ID, that is used for tracking and making sure each detonator has unique number. No two detonators have the same serial ID. The serial ID can range from 16 to 64 bits long. For verification stage, since it is crucial to ensure every detonator is present, the unique serial ID is typically sent out by a blasting machine or logger to the detonators. The detonators reply with a corresponding response or talkback that is sent back to the logger or blasting machine. For verification commands, this may be time consuming, especially in large shots containing more than 1000 detonators, where such process can take up to 12-24 mins to complete. Usually increased communication speed can be achieved via increased bandwidth, i.e. higher frequency, but for large shots with many detonators, the overall RC of the bus line challenges the rise and fall times of the resulting signals, and there is thus a practical limit to the speed.

In such electronic blasting system, the commands issued by the logger or blasting machine can be categorized as individual (specific to each detonator based on unique serial ID) or system level (broadcasted and received by all detonators at same time). For broadcast commands, if multiple detonators respond at same time, the logger/blasting machine is unable to discern which detonators or sets of detonators have responded, unless it starts to query each and every detonator to determine the responding detonators.

SUMMARY

Detonators and master controllers, such as blasting machines or loggers, are provided, in which verify and other communications between the detonator and the remote master controller use a local ID instead of the serial ID to speed up communications. In disclosed examples, the detonators respond to verify and other commands in shortened messages with fewer bits, either synchronously or asynchronously, without having to receive or transmit their individual globally unique serial ID number. The time to respond in one example is achieved synchronously thru clock pulses generated by the logger/blasting machine, or in another example asynchronously by temporal means, e.g., according to the detonators' respective programmed delay times or correlated to the detonator number or other local unique numbering (i.e., no two detonators have same local ID number locally within the blast or in each different branch of a blast. In this manner, verification can be utilized not only to indicate the detonator presence but also to acknowledge other diagnostics, e.g., bus wire (BW) check, arming and calibration. The disclosed techniques can be used for verify or other communications between a remote master controller (e.g., a blasting machine or logger) and the detonators.

BRIEF DESCRIPTION OF THE DRAWINGS

The following description and drawings set forth certain illustrative implementations of the disclosure in detail, which are indicative of several exemplary ways in which the various principles of the disclosure may be carried out. The illustrated examples, however, are not exhaustive of the many possible embodiments of the disclosure. Other objects, advantages and novel features of the disclosure will be set forth in the following detailed description of the disclosure when considered in conjunction with the drawings.

DETAILED DESCRIPTION

Figure 1:
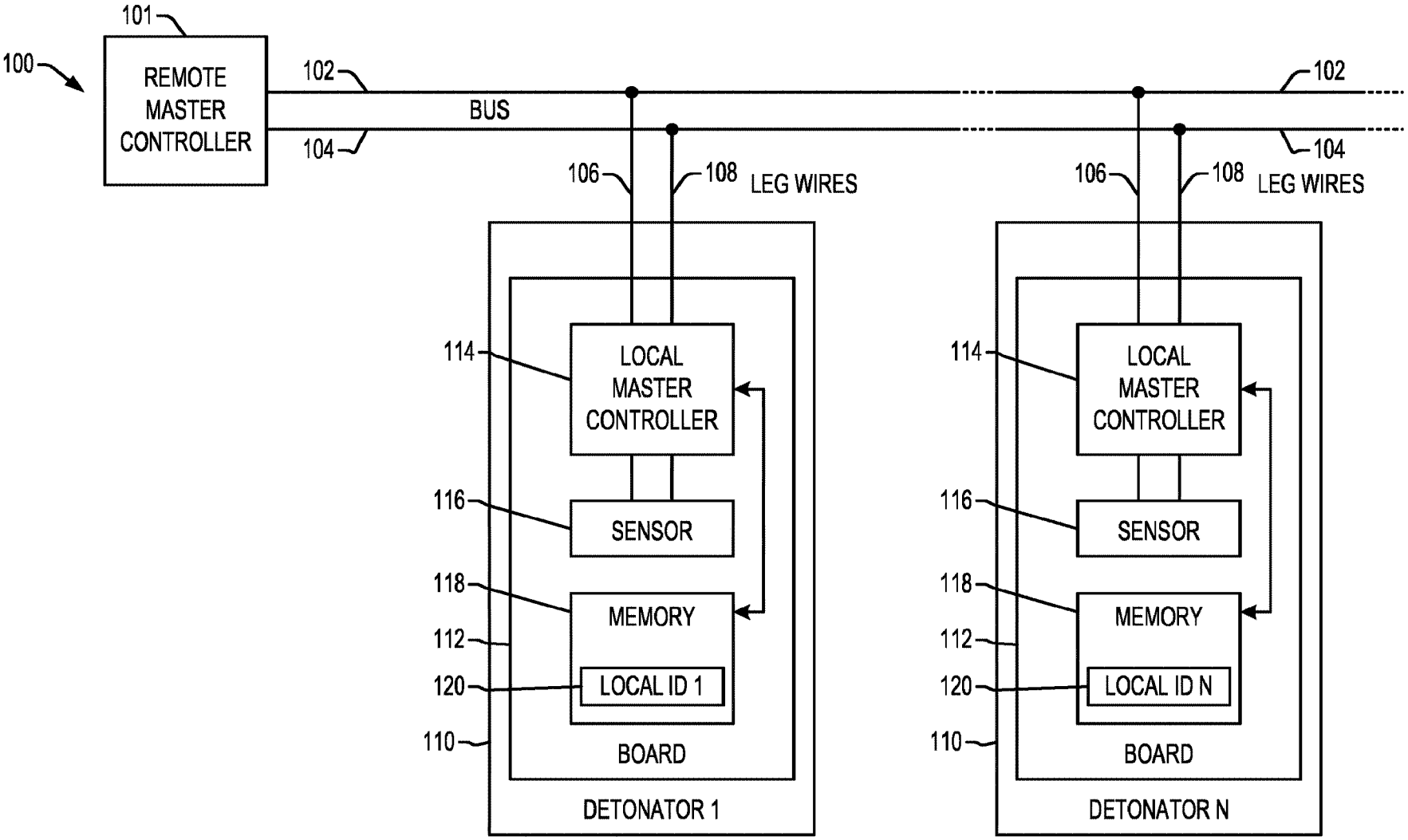
FIG. 1 is a schematic diagram illustrating a detonator with an integrated sensor in a blasting system.

Referring now to the figures, several embodiments or implementations of the present disclosure are hereinafter described in conjunction with the drawings, wherein like reference numerals are used to refer to like elements throughout, and wherein the various features and plots are not necessarily drawn to scale. As used herein, the terms "couple" or "couples" or "coupled" are intended to include indirect or direct electrical or mechanical connection or combinations thereof. For example, if a first device couples to or is coupled with a second device, that connection may be through a direct electrical connection, or through an indirect electrical connection via one or more intervening devices and connections.

FIG. 1 shows a blasting system 100 with electronic detonators 110 that respectively include a printed circuit board (PCB) with a local master controller 114 coupled to an optional sensor 116, for example, a temperature sensor, a pressure sensor, an accelerometer, etc. The system 100 includes a remote master controller 101, such as a blasting machine or a logger. The remote master controller 101 has connections to a bus having first and second bus wires 102 and 104, respectively. The detonator 110 includes connections to first and second leg wires 106 and 108 associated with the individual detonators 110, which are respectively coupled to the first and second bus wires 102 and 104. In one example, the controller 114 is mounted to a substrate, such as the PCB 112. In one example, the sensor 116 is mounted to the PCB 112. In certain implementations, the detonator 110 includes an enclosure (not shown), and the sensor 116 is positioned at least partially inside the enclosure. The detonator 110 in one example is positioned inside a perforating gun or other outer enclosure (not shown). One example of the detonator 110 includes various electrical or electronic components, including components that form an electronic ignition module (EIM) used in electronic detonators. In this example, the local controller 114 is a processor, application-specific IC (ASIC), microcontroller, DSP, FPGA, CPLD, or other integrated circuit or circuits with processing circuitry and internal or external electronic memory 118 that stores a local identification or ID, such as an integer representing a locally unique identity of the individual detonator 110 that is different than the local IDs 120 of all the other interconnected detonators 110. The remote master controller 101 stores a mapping of the local IDs 120 and the respective detonator serial ID numbers established during detonator manufacturing.

In one example, the memory 118 is integral to the controller 114. In another example, the electronic memory 118 is a separate memory on the PCB 112 as shown in FIG. 1. In one example, the electronic memory 118 is non-volatile (e.g., EEPROM, Flash, FeRAM, etc.), and the controller 114 is configured to store multiple measured environmental parameters, historical data, and other data associated with the detonator 110. The controller 114 in one example stores electrical data in the memory 118, such as activity, commands received or operational status indicators and/or active diagnostics, and/or sensor data from the sensor 116 in the non-volatile memory 118. The data can be stored statically with fixed addresses or allocated according to a circular buffer to accommodate on going data acquisition. In certain implementations, the controller 114 also includes interface circuitry, such as analog to digital converters, digital-to-analog converters, communication interface circuits, etc. The controller 114 may also include digital interface circuitry, such as data and/or address buses, serial communications circuits, pulse width modulation outputs, etc. For example, the example controller 114 includes serial communications interface circuitry to provide communications with the remote master controller 101 via the bus lines 102, 104 and the leg wire's 106, 108 in FIG. 1.

The electronic blasting system 100 in FIG. 1 implements 2-way communications between the remote master controller 101 (e.g., blasting machine/logger) and the detonators 110. The blasting machine or logger 101 can issue commands as predefined signals to the detonators 110, whether by amplitude shift keying modulation (ASK) or frequency shift keying (FSK) modulation of a voltage signal generated across the bus wires 102, 104 and the leg wires 106, 108. The detonators 110 respond back with current modulation similarly either in ASK or FSK format. Example of one suitable communications protocol are described below in connection with FIGS. 7-18. The individual electronic detonators 110 may contain electronic processing components to process the incoming command waveforms (microcontroller, microprocessor, FPDA, CPLD, etc.), and the necessary circuits to toggle the current as the talkback response.

The remote master controller (blasting machine or logger) 101 will not use the unique global serial ID number in one, some or all commands (e.g., verify command), but rather includes the reduced or local unique identification 120 based e.g., on the detonator number, delay time or combination thereof. The local ID 120 of each detonator 110 is locally unique throughout the blast site, and no two detonators 110 having the same local unique identification 120. In one example, the remote master controller 101 or an operator ensures this local ID uniqueness either prior to transfer of the local ID data to the blasting machine 101, or the blasting machine and logger 101 ensure that no such duplication exists in their internal memory of the remote master controller 101.

One example implementation is described below with respect to verify commands. The remote master controller 101 (BM or logger) sends out the verify command. All detonators 110 should receive this command, and start to get ready, namely to associate their respective detonator number with clock pulses. The local IDs 120 in one example are integer values that the remote and local controllers 101 and 114 associate with a given one of a series of clock pulses or time windows that follow the verify command.

The remote master controller 101 (BM or logger) next sends out the series of clock pulses corresponding to the total number of detonators 1110 in the shot plus one or more additional clock pulses (e.g., 16 extra pulses). For example, if there are 100 detonators 110 in the blast, the remote master controller 101 (BM or logger) it will send out 116 clock pulses following transmission of the verify command. Each detonator 110 measures the bus wire voltage, and the detonator 110 detects and counts the associated clock pulses. In response to the count matching the local ID 120, the detonator 110 responds with one or more current pulses, such as to represent a bit or a limited series of bits to acknowledge to the remote master controller 101 (blasting machine or logger) that the detonator 110 is present.

Aside from sending out clock pulses by the remote master controller 101 (blasting machine or logger), to sync the detonator responses by the local unique numbering, the detonator 110 may also asynchronously send the response after a predetermined time delay based on the local unique numbering. This response time may be based on the detonator number (e.g., respond at times calculated to be, e.g., x1 or x10 of the detonator number), or the actual programmed delay times (in order of the firing times in the blast) or some factor of these delay times, of which the remote master controller 101 (blasting machine or logger) is aware by the previous configuration and programming for a given blast.

This fast verify comm technique can be extended to other confirmations besides just the presence on the blast, such as diagnostics results (e.g., bridgewire check, bus voltage, firing capacitor charged voltage, internal leakage, calibration value, etc.) or combinations of such status e.g., during arm check to make sure the detonator is properly charged and yield the correct calibration values, and presence on the bus line. A similar command and synchronous or asynchronous response protocol is implemented for such other communications exchanges, alone or in combination with those described above for verify commands.

Figure 2:
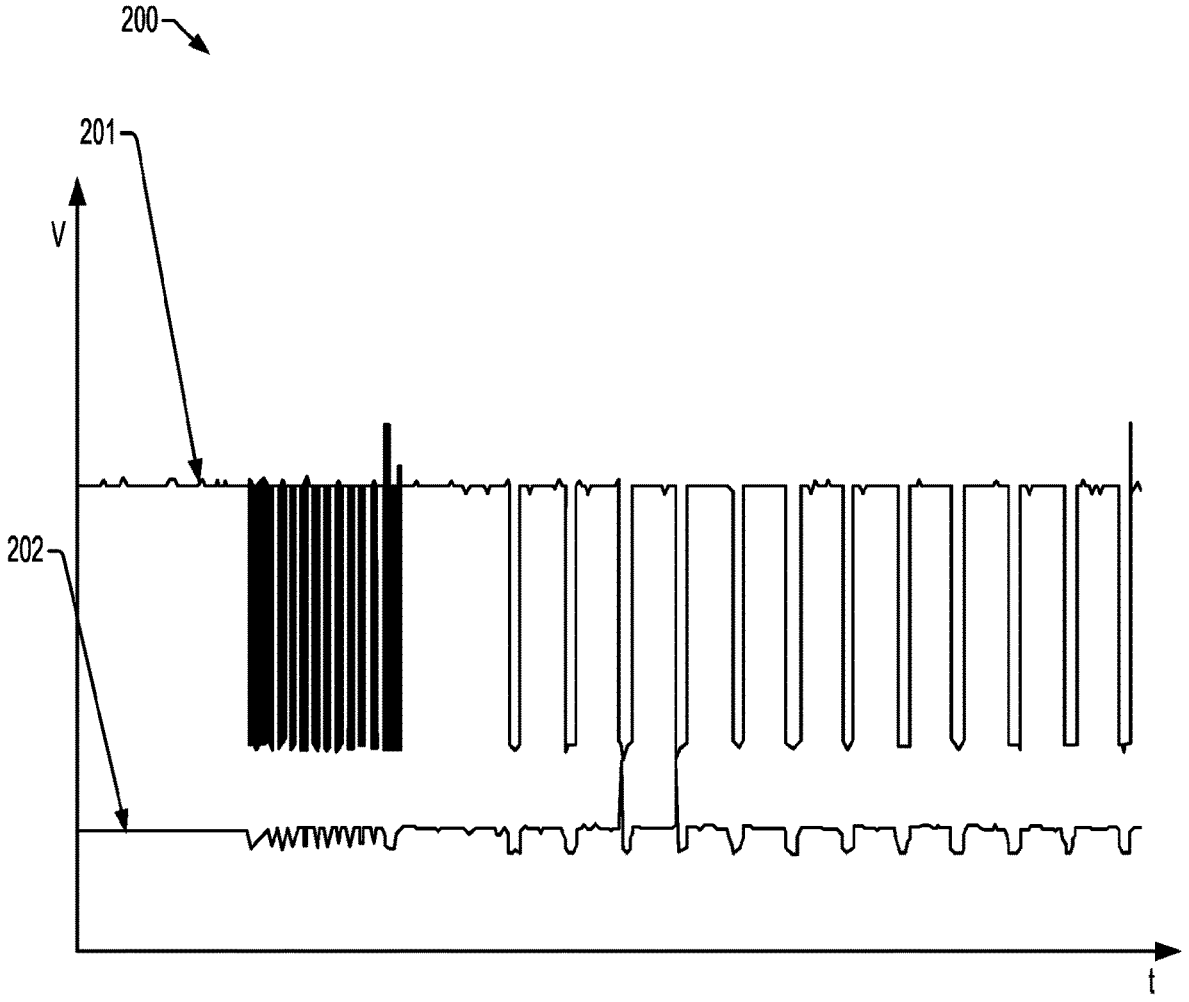
FIGS. 2-6 are bus wire voltage and current signal diagrams.

FIGS. 2-6 show example bus wire voltage and current signal diagrams to illustrate a verify command implementation. A signal diagram 200 in FIG. 2 shows an example verify command 0xAF (e.g., quick verify) with clock pulses in a voltage curve 201, in which detonators #2 and #3 in the local ID mapping respond with bit pulses in a current curve 202 after clock pulses 3 and 4 (e.g., with a clock pulse offset by 1 pulse to allow time for processing of the received verify command by the detonators 110.

Figure 3:
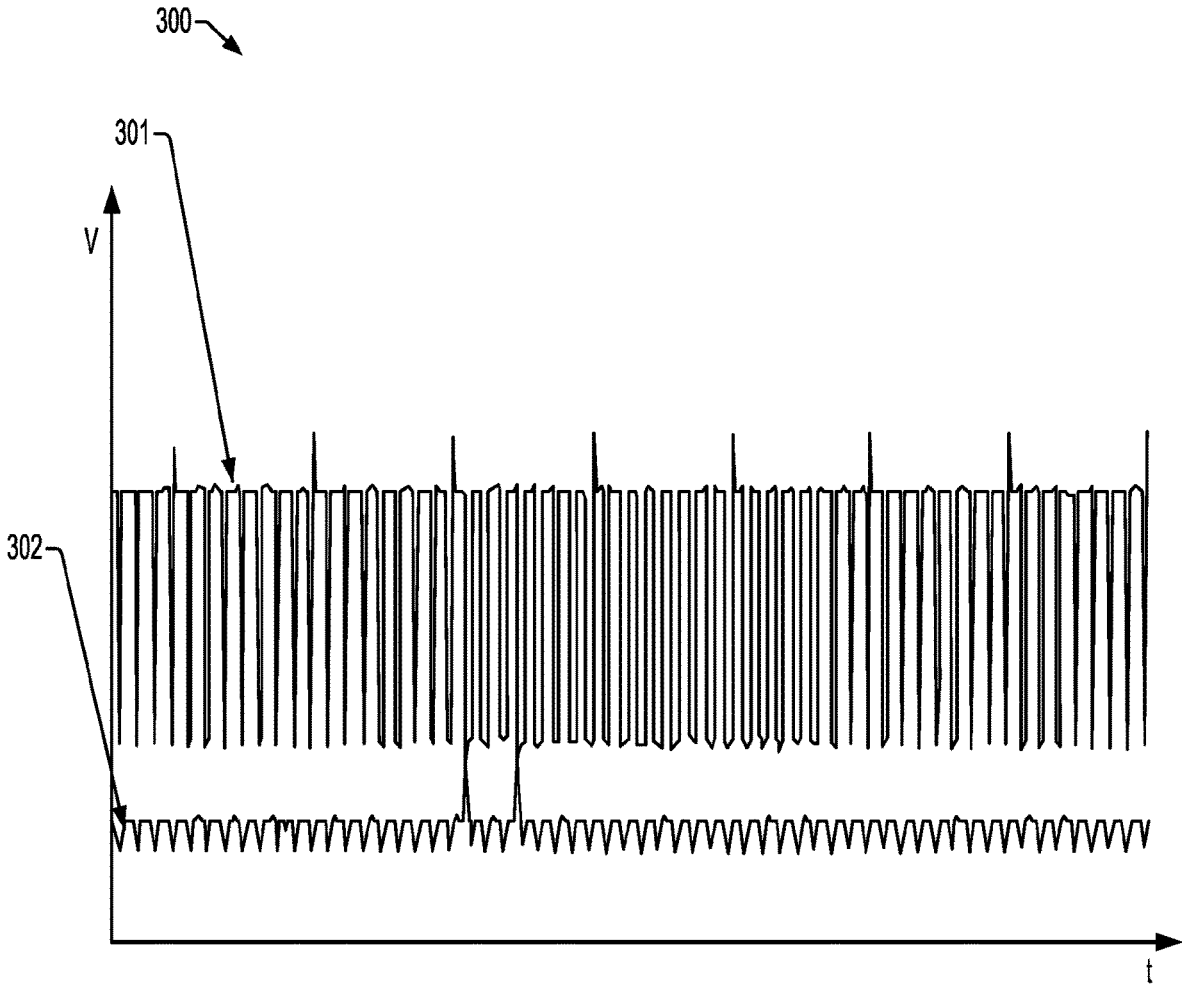

A signal diagram 300 in FIG. 3 shows another example of the same command 0xAF issued by the remote master controller 101 (blasting machine or logger) and seen in a voltage curve 301. In this example, two detonators with respective local IDs 1555 and 1558, responding at end of the corresponding clock pulses, with a gap of two unused clock pulses between the respective responses (e.g., with a total number of 1600 detonators 110, and 1616 total pulses issued in this example).

Figure 4:
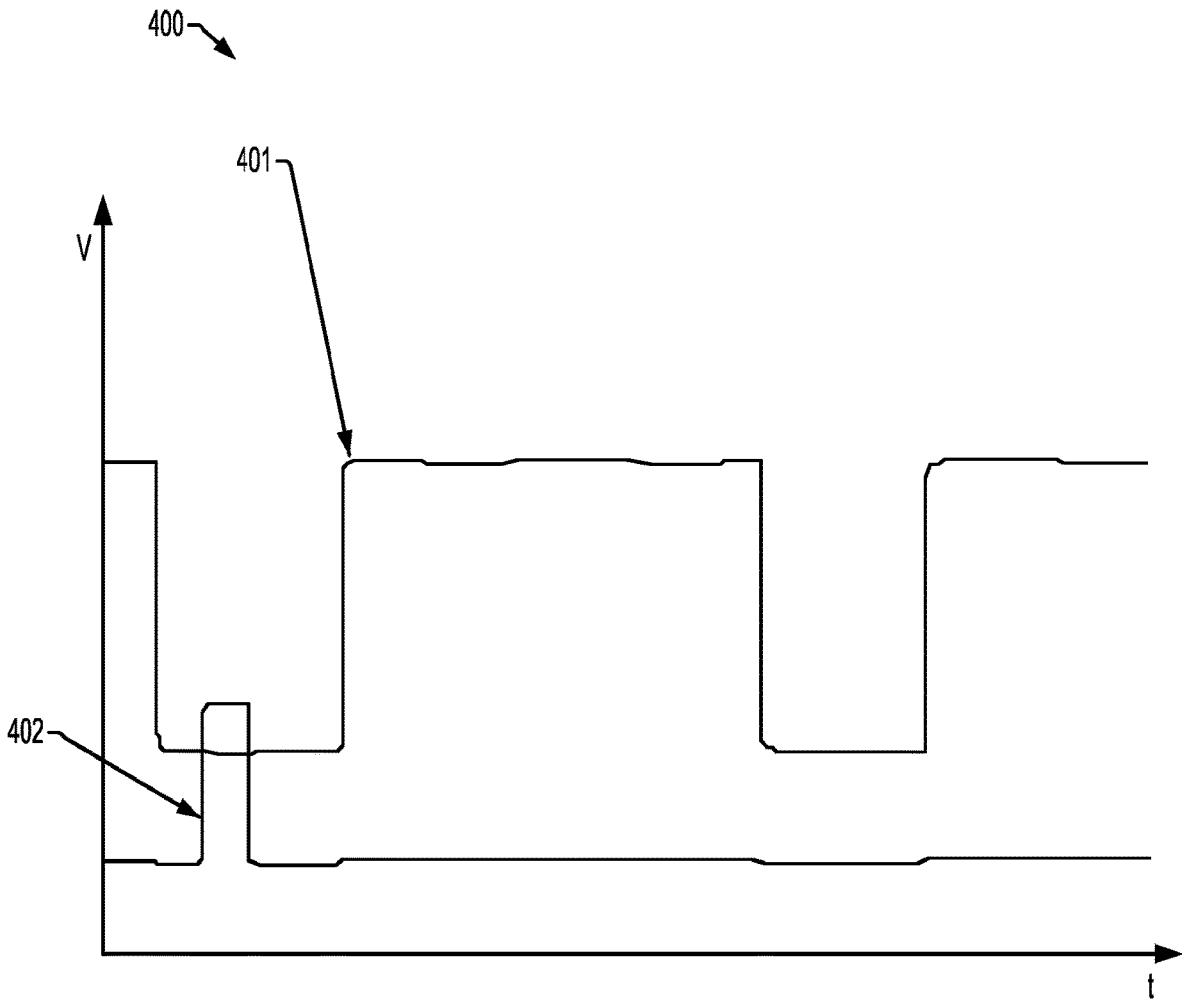

A signal diagram 400 in FIG. 4 shows a voltage curve 401 and a current curve 402 for the bus wires 102 and 104, in which the first clock pulse includes positive talkback in the left pulse (e.g., a response from a detonator 110 with a local ID 120 that corresponds to that clock pulse), but no response in right pulse (e.g., no responding detonator 110 having a local ID 120 that corresponds to that clock pulse). In this instance, the remote master controller 101 (blasting machine or logger) detects that a valid response occurred in the left pulse, and that no valid response occurred in the right pulse.

Figure 5:
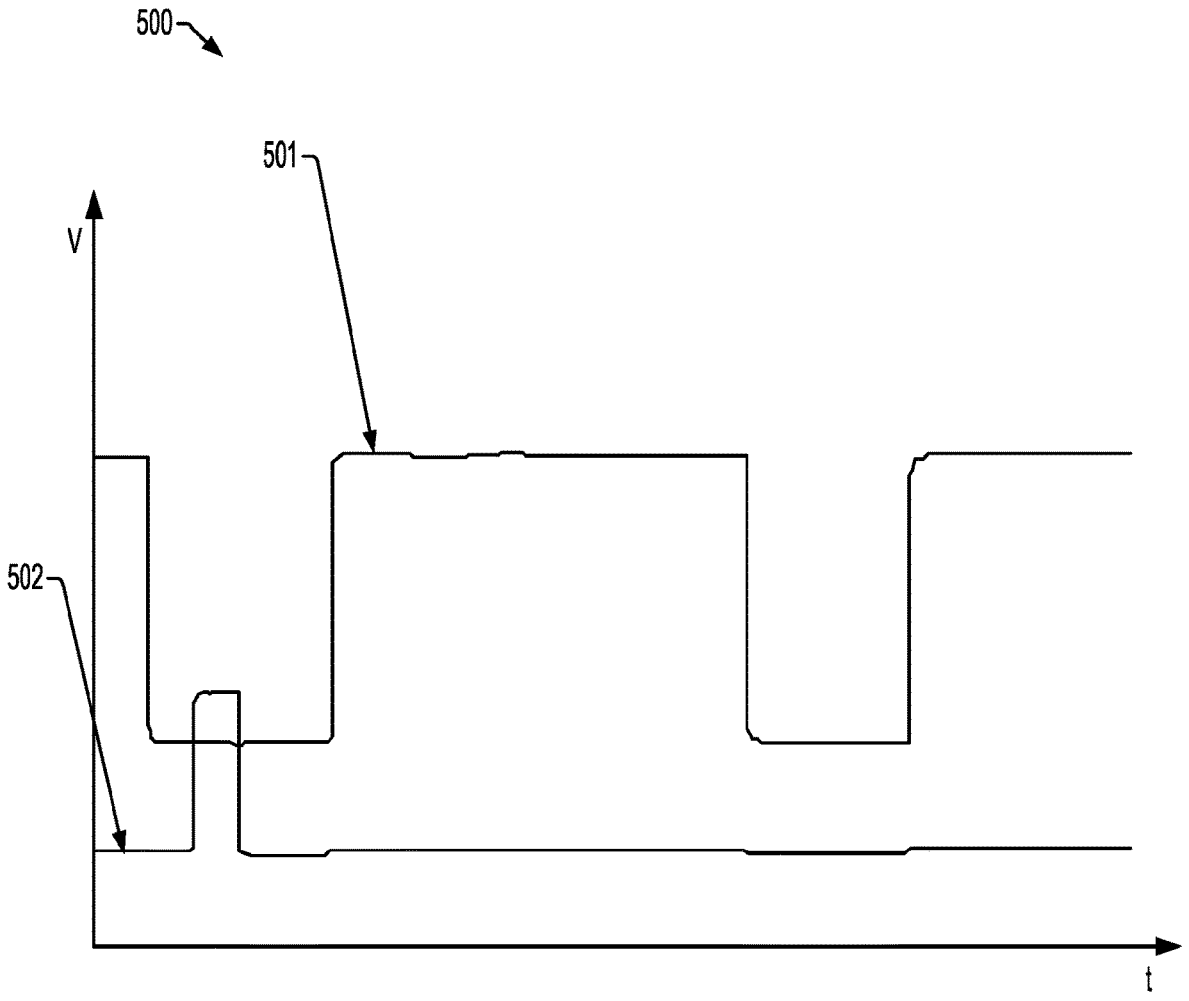
Figure 6:
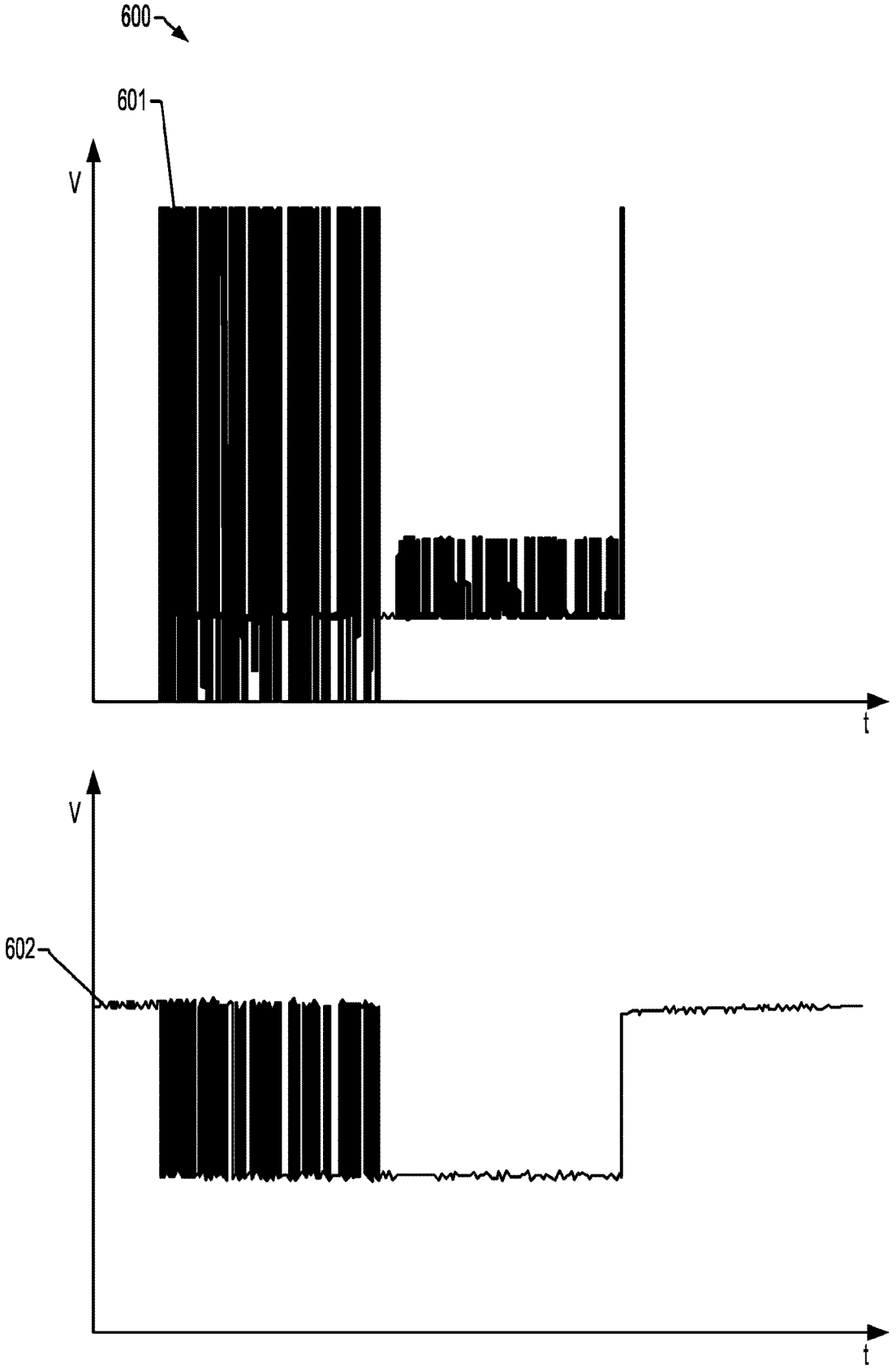

A signal diagram 500 in FIG. 5 illustrates a further improvement over the example of FIG. 4, with a voltage curve 501 and a current curve 502. In this implementation instance, the remote master controller 101 (blasting machine or logger) provides some pause during bus low voltage condition for dynamic baselining to obtain clearer distinction between a positive pulse response and background. A signal diagram 600 in FIG. 6 shows a comparative implementation using actual detonator serial IDs in the verify command voltage pulse (curve 601), as well as in the responsive current pulses (curve 602) from a detonator. As seen in comparison, the communications in FIG. 6 includes full packages, and the detonator responses have the same length as the incoming command package, leading to much longer communications than in the disclosed example.

Figure 7:
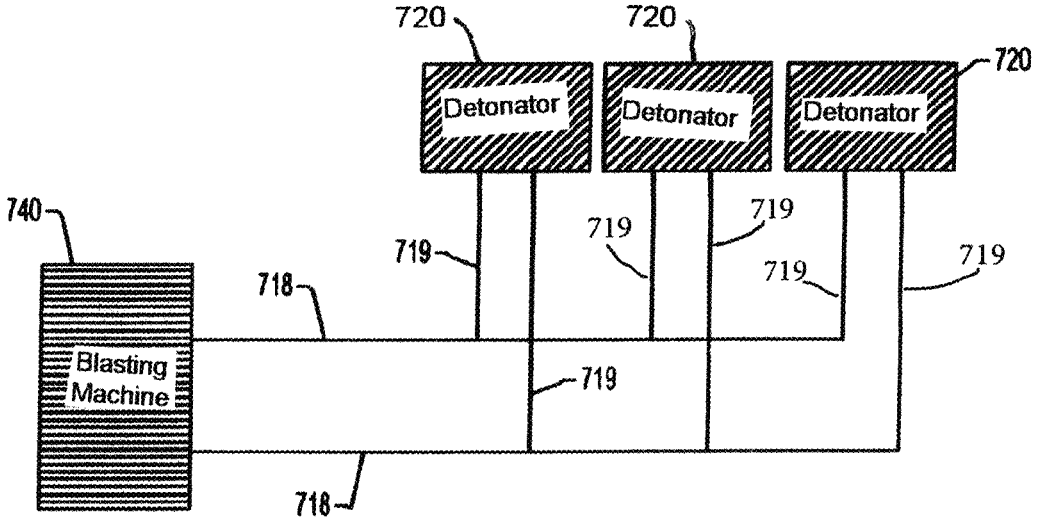
FIG. 7 is an overall view showing a layout of an electronic blasting system in which the present invention may be employed.

To describe the present invention with reference to the details of a particular preferred embodiment, it is noted that the present invention may be employed in an electronic system comprising a network of slave devices, for example, an electronic blasting system in which the slave devices are electronic detonators. As depicted in FIG. 7, one embodiment of such an electronic blasting system may comprise a number of detonators 720, a two-line bus 718, leg wires 719 including connectors for attaching the detonator to the bus 718, a logger (not shown), and a blasting machine 740. The detonators 720 are preferably connected to the blasting machine 740 in parallel (as in FIG. 7) or in other arrangements including branch (as with the branched bus 718' shown in FIG. 8), tree, star, or multiple parallel connections. A preferred embodiment of such an electronic blasting system is described below, although it will be readily appreciated by one of ordinary skill in the art that other systems or devices could also be used, and many configurations, variations, and modifications of even the particular system described here could be made, without departing from the spirit and scope of the present invention.

The blasting machine 740 and logger may preferably each have a pair of terminals capable of receiving bare copper (bus) wire up to, for example, 14-gauge. The logger's terminals may also preferably be configured to receive steel detonator wires (polarity insensitive), and the logger should have an interface suitable for connecting to the blasting machine 740. The blasting machine 740 and logger are preferably capable of being operated by a person wearing typical clothing used in mining and blasting operations, e.g., thick gloves. The blasting machine 740 and logger may preferably be portable handheld battery-powered devices that require password entry to permit operation and have illuminated displays providing menus, instructions, keystroke reproduction, and messages (including error messages) as appropriate. The blasting machine 740 may preferably have a hinged lid and controls and indicators that include a lock for the power-on key, a numeric keypad with up/down arrows and "enter" button, a display, an arming button, an indicator light(s), and a firing button.

The blasting machine 740 and logger should be designed for reliable operation in the anticipated range of operating temperatures and endurance of anticipated storage temperatures and are preferably resistant to ammonium nitrate and commonly-used emulsion explosives. The blasting machine 740 and logger are also preferably robust enough to withstand typical treatment in a mining or blasting environment such as being dropped and trodden on, and may thus have casings that are rugged, water and corrosion-resistant and environmentally sealed to operate in most weather. The blasting machine 740 and logger should, as appropriate, meet applicable requirements of CEN document prCEN/TS 13763-27 (NMP 898/FABERG N 0090 D/E) E 2002 Jun. 19 and governmental and industry requirements. To the extent practical, the logger is preferably designed to be incapable of firing any known electric and electronic detonators and the blasting machine 740 to be incapable of firing all known electric detonators and any other known electronic detonators that are not designed for use with the blasting machine 740. An initial electrical test of the system to detect such a device can be employed to provide further assurance that unintended detonators are not fired.

The bus 718 may be a duplex or twisted pair and should be chosen to have a pre-selected resistance (e.g., in the embodiment described here, preferably 30 to 75 (2 per single conductor. The end of the bus 718 should not be shunted, but its wire insulation should be sufficiently robust to ensure that leakage to ground, stray capacitance, and stray inductance are minimized (e.g., in the embodiment described herein, preferably less than 100 mA leakage for the whole bus, 50 pF/m conductor-to-conductor stray capacitance, and 1 μH/m conductor-to-conductor stray inductance) under all encountered field conditions.

The leg wires 719 and contacts should be chosen to have a pre-selected resistance measured from the detonator terminal to the detonator-to-bus connector (e.g., in the embodiment described here, 50 to 100Ω per single conductor plus 25 mΩ per connector contact). It will be recognized that the particular detonator-to-bus connector that is used may constrain the choice of bus wire. From a functional standpoint, the detonators 720 may be attached at any point on the bus 718, although they must of course be a safe distance from the blasting machine 740.

Figure 9:
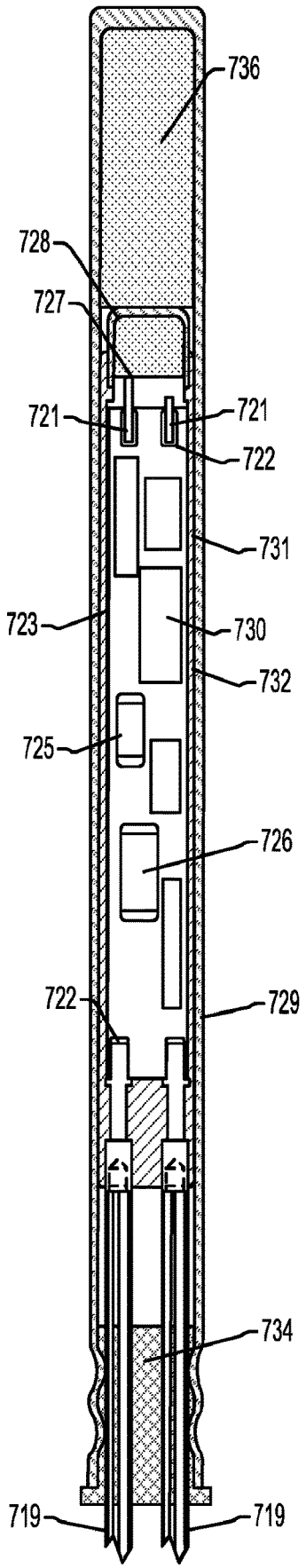
FIG. 9 is a sectional view of a preferred detonator that may be used in the electronic blasting system of FIGS. 7 and 8.

As shown in FIG. 9, a suitable detonator 720 for use in an electronic blasting system such as that described here may comprise an electronic ignition module (EIM) 723, a shell 729, a charge 736 (preferably comprising a primary charge and base charge), leg wires 719, and an end plug 734 that may be crimped in the open end of the shell 729. The EIM 723 is preferably programmable and includes an igniter 728 and a circuit board to which may be connected various electronic components. In the embodiment described here, the igniter 728 is preferably a hermetically sealed device that includes a glass-to-metal seal and a bridgewire 727 designed to reliably ignite a charge contained within the igniter 728 upon the passage through the bridgewire 727 of electricity via pins 721 at a predetermined "all-fire" voltage level. The EIM 723 (including its electronics and part or all of its igniter 728) may preferably be insert-molded into an encapsulation 731 to form a single assembly with terminals for attachment of the leg wires 719. Assignee's copending U.S. patent application Ser. No. 10/158,317 (at pages 5-8 and FIGS. 1-5) and Ser. No. 10/158,318 (at pages 3-8 and FIGS. 1-6), both filed on May 29, 2002, are hereby incorporated by reference for their applicable teachings of the construction of such detonators beyond the description that is set forth herein. As taught in those applications, an EIM 723 generally like the one depicted in FIG. 9 can be manufactured and handled in standalone form, for later incorporation by a user into the user's own custom detonator assembly (including a shell 729 and charge 736).

The circuit board of the EIM 723 is preferably a microcontroller or programmable logic device or most preferably an application-specific integrated circuit chip (ASIC) 730, a filtering capacitor 724, a storage capacitor 725 preferably, e.g., 3.3 to 10 μF (to hold a charge and power the EIM 723 when the detonator 720 is responding back to a master device as discussed further below), a firing capacitor 726 (preferably, e.g., 47 to 374 μF) (to hold an energy reserve that is used to fire the detonator 720), additional electronic components, and contact pads 722 for connection to the leg wires 719 and the igniter 728. A shell ground connector 732 protruding through the encapsulation 731 for contact with the shell 729 and connected to, e.g., a metal can pin on the ASIC 730 (described below), which is connected to circuitry within the ASIC 730 (e.g., an integrated silicon controlled resistor or a diode) that can provide protection against electrostatic discharge and radio frequency and electromagnetic radiation that could otherwise cause damage and/or malfunctioning.

Figure 10:
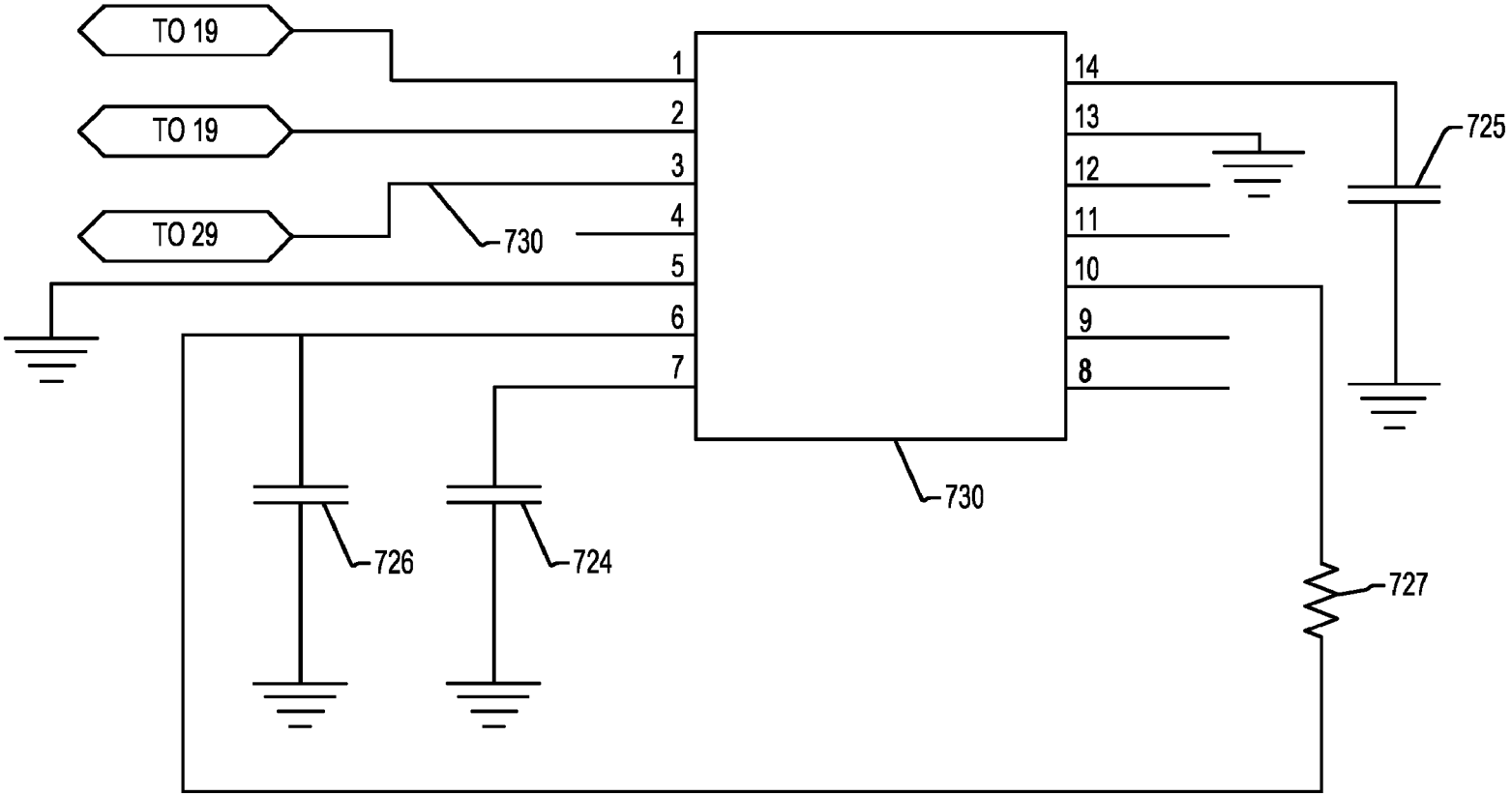
FIG. 10 is a schematic representation of the major electrical aspects of the electronic ignition module (EIM) of the detonator of FIG. 9, including an application-specific integrated circuit (ASIC).

Referring to FIG. 10, a preferred electronic schematic layout of a detonator 720 such as that of FIG. 9 is shown. The ASIC 730 is preferably a mixed signal chip with dimensions of 3 to 6 mm. Pins 1 and 2 of the depicted ASIC 730 are inputs to the leg wires 719 and thus the bus 718, pin 3 is for connection to the shell ground connector 732 and thus the shell 729, pin 6 is connected to the firing capacitor 726 and bridgewire 727, pin 7 is connected to the filtering capacitor 724, pin 10 is connected to the bridgewire 727, pin 13 is grounded, and pin 14 is connected to the storage capacitor 725.

Figure 11:
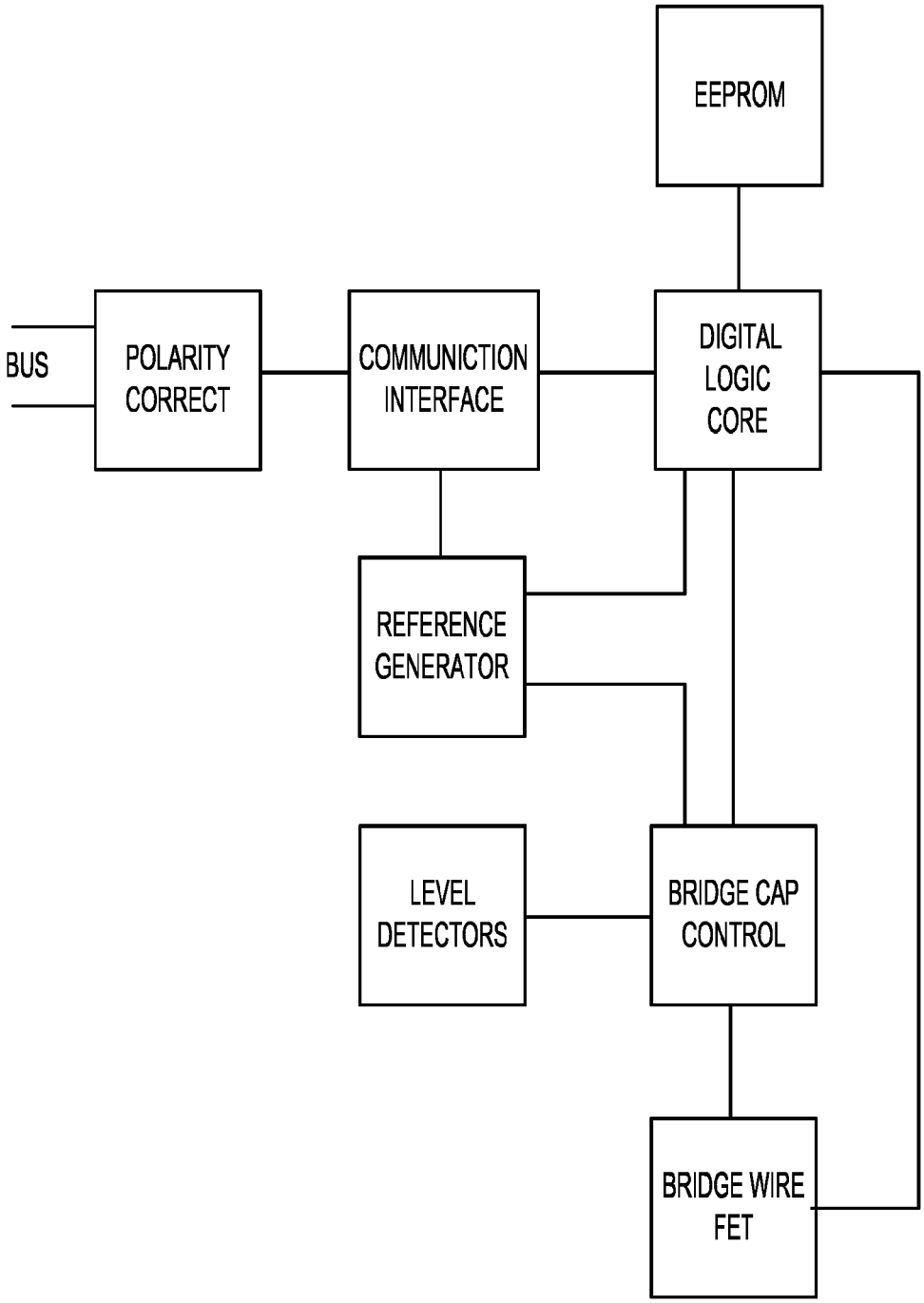
FIG. 11 is a schematic representation of a preferred circuit design for the ASIC of FIG. 10.

Referring specifically now to FIG. 11, the ASIC 730 may preferably consist of the following modules: polarity correct, communications interface, EEPROM, digital logic core, reference generator, bridge capacitor control, level detectors, and bridgewire FET. As shown, the polarity correct module may employ polarity-insensitive rectifier diodes to transform the incoming voltage (regardless of its polarity) into a voltage with common ground to the rest of the circuitry of the ASIC 730. The communication interface preferably shifts down the voltages as received from the blasting machine 740 so that they are compatible with the digital core of the ASIC 730, and also toggles and transmits the talkback current (described below) to the rectifier bridge (and the system bus lines) based on the output from the digital core. The EEPROM module preferably stores the unique serial identification, delay time, hole registers and various analog trim values of the ASIC 730. The digital logic core preferably holds the state machine, which processes the data incoming from the blasting machine 740 and outgoing talkback via the communication interface. Reference generators preferably provide the regulated voltages needed to power up the digital core and oscillator (e.g., 3.3V) and also the analog portions to charge the firing capacitor 726 and discharge the firing MOSFET. The bridge capacitor control preferably contains a constant current generator to charge up the firing capacitor 726 and also a MOSFET to discharge the firing capacitor 726 when so desired. The level detectors are preferably connected to the firing capacitor 726 to determine based on its voltage whether it is in a charged or discharged state. Finally, the bridgewire MOSFET preferably allows the passage of charge or current from the firing capacitor 726 across the bridgewire 727 upon actuation by pulling to ground.

Communication Protocol

Figure 8:
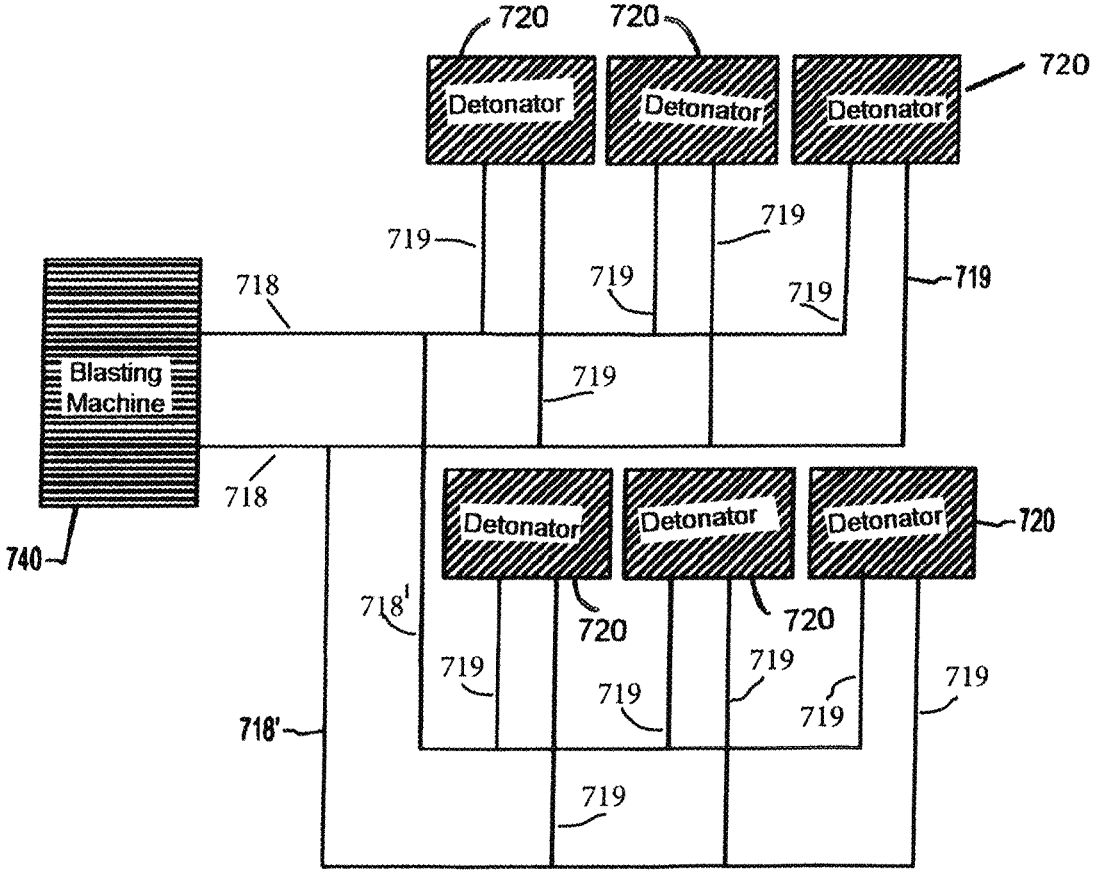
FIG. 8 is an overall view showing a layout of an alternate configuration of such an electronic blasting system.

Communication of data in a system such as shown in FIGS. 7 and 8 may preferably consist of a 2-wire bus polarity independent serial protocol between the detonators 720 and a logger or blasting machine 740. Communications from the blasting machine 740 may either be in individual mode (directed to a particular detonator 720 only) or broadcast mode where all the detonators 720 will receive the same command (usually charging and fire commands). The communication protocol is preferably serial, contains cyclic redundancy error checking (CRC), and synchronization bits for timing accuracy among the detonators 720. There is also a command for the auto-detection of detonators 720 on the bus 718 that otherwise had not been entered into the blasting machine 740.

When the blasting machine 740 and detonators 720 are connected, the system idle state voltage is preferably set at VB,H. The slave detonators 720 then preferably obtain their power from the bus 718 during the high state, which powers up their storage capacitors 725. Communications from the blasting machine 740 or logger to the ASICs 730 is based on voltage modulation pulsed at the appropriate baud rate, which the ASICs 730 decipher into the associated data packets.

Figure 12A:
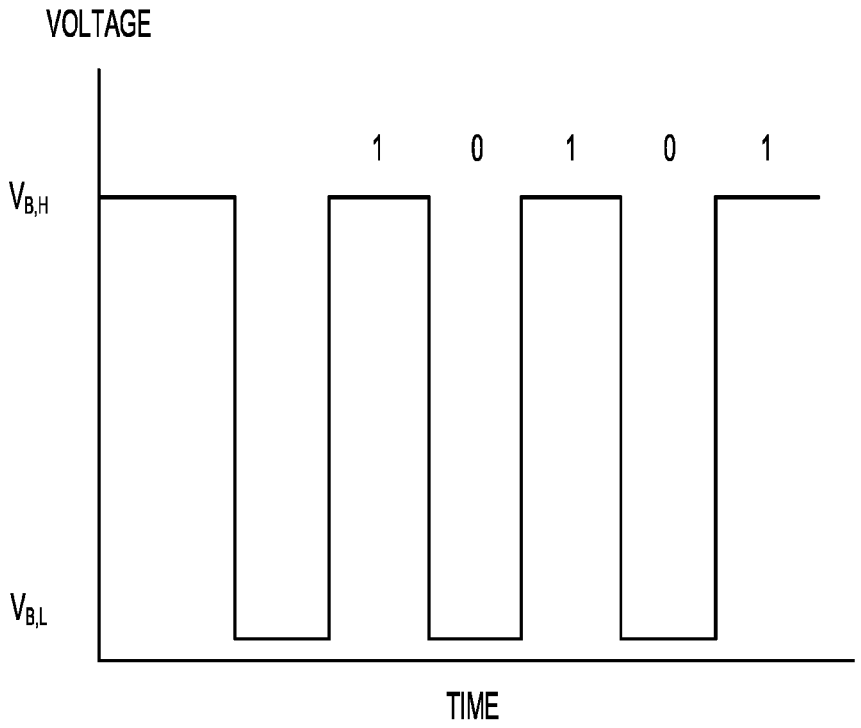
FIG. 12*a* is a graph of voltage versus time illustrating a preferred voltage modulation-based communication from a blasting machine to detonators in the electronic blasting system of FIGS. 7 and 8.
Figure 12B:
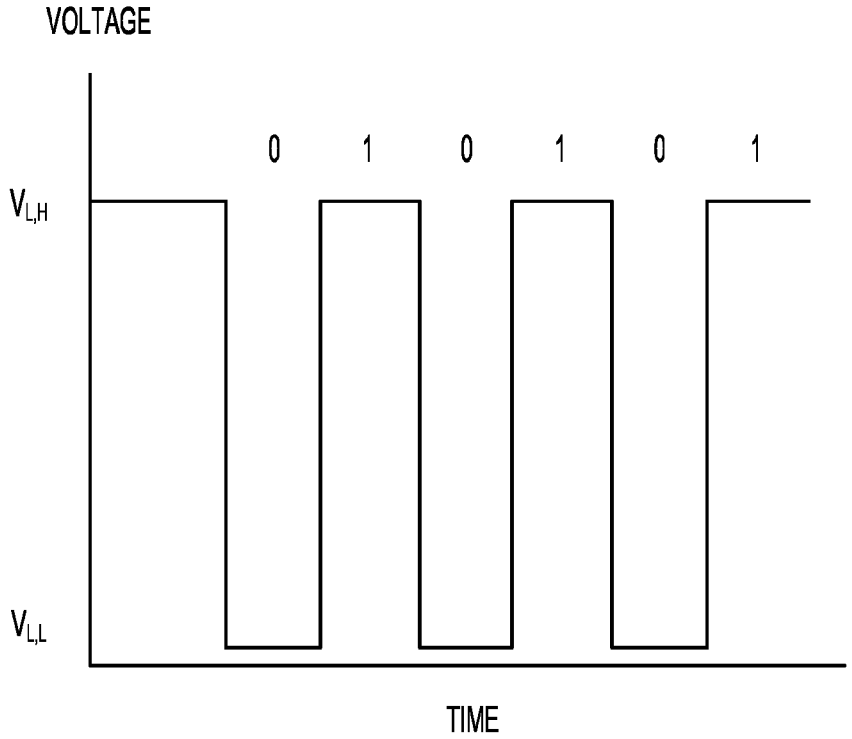
FIG. 12*b* is a graph of voltage versus time illustrating a preferred voltage modulation-based communication from a logger to detonator(s) the electronic blasting system of FIGS. 7 and 8.

As shown in FIGS. 12*a* and 12*b*, different operating voltages VL,L and VL,H can be used by the logger versus those of the blasting machine 740, VB,L and VB,H. In the embodiment described here, suitable values for VL,L and VL,H are 1 to 3V and 5.5 to 14V, respectively, while suitable values for VB,L and VB,H are 0 to 15V and 28V or higher, respectively. Further, a detonator 720 in such a system may preferably utilize this difference to sense whether it is connected to the blasting machine 740 or logger (i.e., whether it is in logger or blaster mode), such as by going into logger mode when the voltage is less than a certain value (e.g., 15V) and blaster mode when it is above another value (e.g., 17V). This differentiation permits the ASIC 730 of the detonator 720 to, when in logger mode, preferably switch on a MOSFET to discharge the firing capacitor 726 and/or disable its charging and/or firing logic. The differentiation by the detonator 720 is also advantageously simplified if there is no overlap between the high/low ranges of the blasting machine 740 and the logger, as shown in FIGS. 12*a* and 12*b*. (Each of these figures depicts nominal values for high and low, but it is further preferable that the maximum and minimum acceptable values for the highs and lows also do not permit overlap).

Figure 13A:
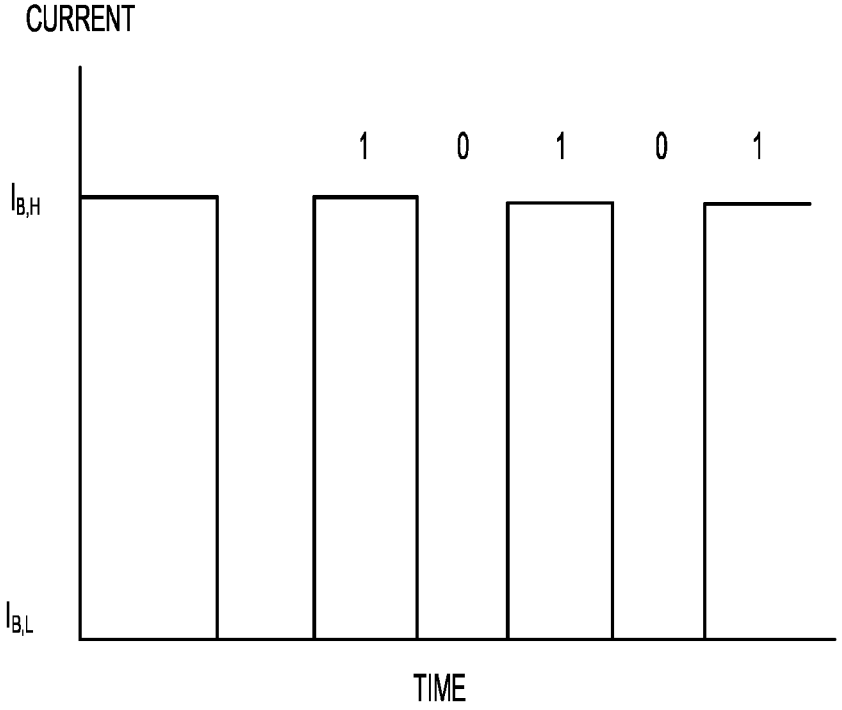
FIG. 13*a* is a graph of current versus time illustrating a preferred current modulation-based response back from a detonator to a blasting machine the electronic blasting system of FIGS. 7 and 8.
Figure 13B:
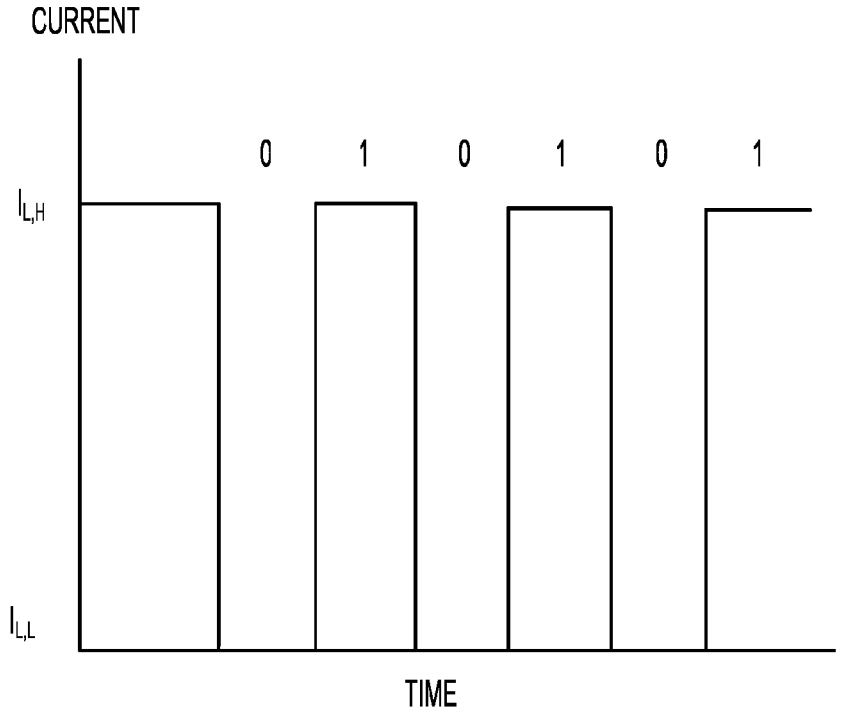
FIG. 13*b* is a graph of current versus time illustrating a preferred current modulation-based response back from a detonator(s), to a logger the electronic blasting system of FIGS. 7 and 8.

On the other hand, instead of voltage modulation, the communication from the ASICs 730 to the blasting machine 740 or logger is based on current modulation ("current talkback"), as shown in FIGS. 13*a* and 13*b*. With current modulation, the ASICs 730 toggle the amount of current to the logger (between IL,L, preferably 0 mA, and IL,H, preferably a value that is at least 0.1 mA but substantially less than IB,H) or blasting machine 740 (between IB,L, preferably 0 mA, and IB,H, preferably a value that is at least 5 mA but not so high as to possibly overload the system when multiple detonators 720 respond), which then senses and deciphers these current pulse packets into the associated data sent. This current talkback from the detonators back to the master can be performed when the voltage of the bus 718 is high or low, but if performed when the bus 718 is high, the ASICs 730 are continuously replenishing the storage capacitors 725, causing a high background current draw (especially when many detonators 720 are connected to the bus 718). When the bus 718 is preferably held low, however, the rectifier bridge diodes are reverse-biased and the ASICs 730 draw operating current from the storage capacitors 725 rather than the bus 718, so as to improve the signal-to-noise ratio of the sensed talkback current at the blasting machine 740 or logger. Thus, the current talkback is preferably conducted when the bus 718 is held low. The toggling of current by the ASICs 730 can be suitably achieved by various known methods such as modulating the voltage on a sense resistor, a current feedback loop on an op amp, or incorporating constant current sinks, e.g., current mirror.

Serial Data Communication (Serial Data Line) Organization

In communications to and from the master devices and slave devices, the serial data communication interface may preferably comprise a packet consisting of a varying or, more preferably, a fixed number (preferably 10 to 20) of "bytes" or "words" that are each preferably, e.g., twelve bits long, preferably with the most significant bit being sent first. Depending on the application, other suitable sized words could alternately be used, and/or a different number of words could be used within the packet. Also, a different packet structure could alternately be employed for communications from the master device as compared to those of communications from the slave devices.

The first word of the packet of the embodiment described here is preferably an initial synchronization word and can be structured such that its first three bits are zero so that it is effectively received as a nine-bit word (e.g., 101010101, or any other suitable arrangement).

In addition to containing various data as described below, the subsequent words may also preferably each contain a number of bits—for example, four bits at the beginning or end of each word—that are provided to permit mid-stream resynchronization (resulting in a word structured as 0101_D7:D0 or D7:D0-0101 and thus having eight bits that can be used to convey data, or "data bits"). Preferred schemes of initial synchronization and re-synchronization are described further under the corresponding heading below.

Another word of the packet can be used to communicate commands, such as is described under the corresponding heading below.

Preferably five to eight additional bytes of the packet are used for serial identification (serial ID) to uniquely (as desired) identify each detonator in a system. The data bits of the serial ID data may preferably consist at least in part of data such as revision number, lot number, and wafer number, for traceability purposes. In broadcast commands from the master device, these words do not need to contain a serial ID for a particular detonator and thus may consist of arbitrary values, or of dummy values that could be used for some other purpose.

Additional words of the packet are preferably used to convey delay time information (register) (and comprise enough data bits to specify a suitable range of delay time, e.g., in the context of an electronic blasting system, a maximum delay of on the order of, e.g., a minute) in suitable increments, e.g., 1 ms in the context of an electronic blasting system. (A setting of zero is preferably considered a default error).

In the embodiment described here, one or more additional words of the packet are preferably used for scratch information, which can be used to define blasting hole identifications (hole IDs), with these words comprising enough data bits to accommodate the maximum desired number of hole IDs.

One or more additional words of the packet are preferably used for a cyclic redundancy check (for example, using CRC-8 algorithm based on the polynomial, x8+x2+x+1), or less preferably, a parity check, or an error-correction check, e.g., using hamming code. Preferably, neither the initial synchronization word nor the synchronization bits are used in the CRC calculation for either transmission or reception.

Synchronization Word and Re-Synchronization Bits

In the embodiment and application described here, a preferred range of possible communication rates may be 300 to 9600 baud. In a packet sent by the master device, the initial synchronization word is used to determine the speed at which the slave device receives and processes the next word in the packet from the master device; likewise, in a packet sent by the slave device, the initial synchronization word is used to determine the speed at which the master device receives and processes the next word from the slave device. The first few (enough to obtain relatively accurate synchronization), but not all, of the bits of this initial synchronization word are preferably sampled, in order to permit time for processing and determination of the communication rate prior to receipt of the ensuing word. Synchronization may be effected by, e.g., the use of a counter/timer monitoring transitions in the voltage level low to high or high to low, and the rates of the sampled bits are preferably averaged together. Throughout transmission of the ensuing words of the packet, i.e., "mid-stream," resynchronization is then preferably conducted by the receiving device assuming that (e.g., 4-bit) synchronization portions are provided in (preferably each of) those ensuing words. In this way, it can be ensured that synchronization is not lost during the transfer of a packet.

Figure 14:
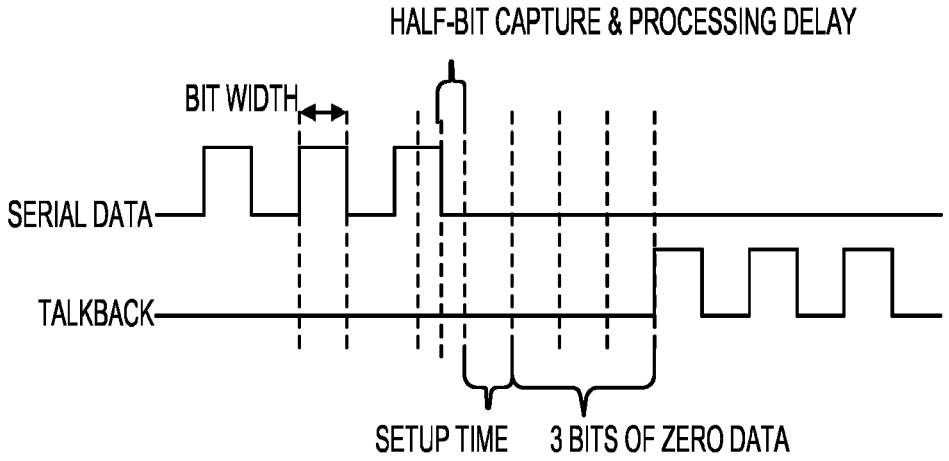
FIG. 14 is a graph illustrating communication to a detonator and response back from the detonator to any response-eliciting command other than an Auto Bus Detection command.
Figure 15:
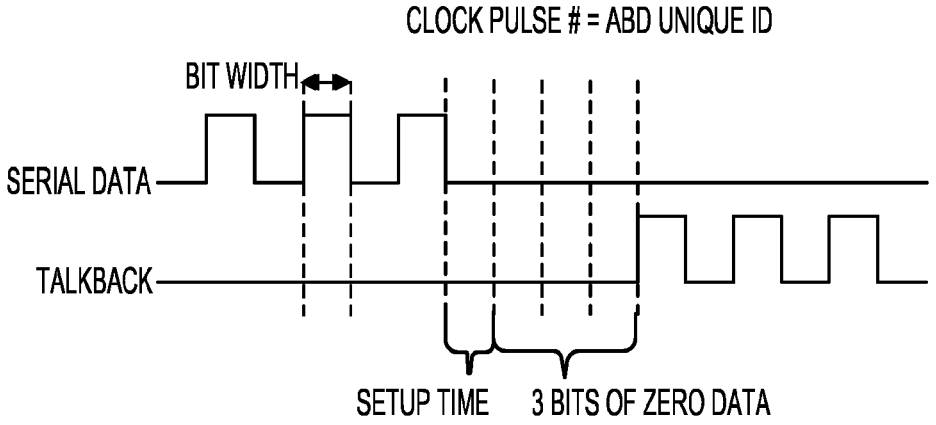
FIG. 15 is a graph illustrating communication to a detonator and response back from the detonator in response to an AutoBus Detection command.

If requested, a slave device responds back, after transmission of a packet from the master device, at the last sampled rate of that packet, which is preferably that of the last word of the packet. (This rate can be viewed as the rate of the initial synchronization word as skewed during the transmission of the packet—in an electronic blasting machine, such skew is generally more pronounced during communication from the detonator to the logger). Referring to FIGS. 14 and 15, communication from a master to a slave device, and a synchronized response back from the slave device, is shown.

As depicted in FIG. 14, the device may preferably be configured and programmed to initiate a response back to individually-addressed commands no later than a predetermined period (after the end trailing edge of the serial input transfer) comprising the time required to complete the input transfer, the serial interface setup for a response back, and the initial portion of the synchronization word (e.g., 000101010101). Preferably the bus 718 should be pulled (and held) low within the capture and processing delay.

Command Word

The data bits of the command word from the master device (e.g., blasting machine or logger) in the serial communication packet may preferably be organized so that one bit is used to indicate (e.g., by being set high) that the master device is communicating, another is used to indicate whether it is requesting a read or a write, another indicates whether the command is a broadcast command or a single device command, and other bits are used to convey the particular command. Similarly, the data bits of the command word from the slave device (e.g., detonator) may preferably be organized so that one bit is used to indicate that the device is responding (e.g., by being set high), another indicates whether a CRC error has occurred, another indicates whether a device error (e.g., charge verify) has occurred, and other bits are discretely used to convey "status flags."

The flag data bits from devices can be used to indicate the current state of the device and are preferably included in all device responses. The flags can be arranged, for example, so that one flag indicates whether or not the device has been detected on the bus, another indicates whether it has been calibrated, another indicates whether it is currently charged, and another indicates whether it has received a Fire command. A flag value of 1 (high) can then signify a response in the affirmative and 0 (low) in the negative.

A preferred set of useful substantive blasting machine/logger commands may include: Unknown Detonator Read Back (of device settings); Single Check Continuity (of detonator bridgewire); Program Delay/Scratch; Auto Bus Detection (detect unidentified devices); Known Detonator Read Back; Check Continuity (of the detonators' bridgewires); Charge (the firing capacitors); Charge Verify; Calibrate (the ASICs' internal clocks); Calibrate Verify; Fire (initiates sequences leading to firing of the detonators); DisCharge; DisCharge Verify; and, Single DisCharge. As will be explained further below, some of these commands are "broadcast" commands (sent with any arbitrary serial identification and its concomitant proper CRC code) that only elicit a response from any detonator(s) that have not been previously identified or in which an error has occurred, while others are directed to a specific detonator identified by its serial ID. FIGS. 16*a-d* show a flowchart of a preferred logical sequence of how such commands may be used in the operation of an electronic blasting system, and specific details of the preferred embodiment described here are set forth for each individual command under the Operation headings.

Operation—by Logger

In use, the detonators 720 are preferably first each connected individually to a logger, which preferably reads the detonator serial ID, performs diagnostics, and correlates hole number to detonator serial ID. At this point, the operator can then program the detonator delay time if it has not already been programmed. Once a detonator 720 is connected to the logger, the operator powers up the logger and commands the reading of serial ID, the performing of diagnostics, and, if desired, the writing of a delay time. As the serial ID is read, the logger may assign a sequential hole number and retains a record of the hole number, serial ID, and delay time.

The foregoing sequence can beneficially be accomplished using the above-noted Unknown Detonator Read Back and Single Check Continuity commands and possibly the Program Delay/Scratch command. Preferred details of these commands are set forth below.

Unknown Detonator Read Back

By this command, the blasting machine 740 or logger requests a read back of the serial ID, delay time, scratch information, and status flags (notably including its charge status) of a single, unknown detonator 720. The bus detection flag is not set by this command. (As an alternate to this command, the logger could instead perform a version of the Auto Bus Detection and Known Detonator Read Back commands described below).

Single Check Continuity

By this command, the logger requests a continuity check of a single detonator 720 of which the serial ID is known. The logger may (preferably) issue this command prior to the programming (or re-programming) of a delay time for the particular detonator 720. In response to this command, the ASIC 730 of the detonator 720 causes a continuity check to be conducted on the bridgewire 727. The continuity check can be beneficially accomplished, for example, by the ASIC 730 (at its operating voltage) causing a constant current (e.g., about 27 μA with a nominally 1.8Ω bridgewire 727 in the embodiment described here) to be passed through the bridgewire 727 via, e.g., a MOSFET switch and measuring the resulting voltage across the bridgewire 727 with, e.g., an A/D element. The overall resistance of the bridgewire 727 can then be calculated from the ohmic drop across the bridgewire 727 and the constant current used. If the calculated resistance is above a range of threshold values (e.g., in the embodiment described here, 30 to 60 kΩ range), the bridgewire 727 is considered to be open, i.e., not continuous. If such error is detected, then the detonator 720 responds back with a corresponding error code (i.e., continuity check failure as indicated by the respective data bit of the command word).

Program Delay/Scratch

By this command, if the detonator 720 has not already been programmed with a delay time or if a new delay time is desired, the operator can program the detonator 720 accordingly. Through this command, the blasting machine 740 or logger requests a write of the delay and scratch information for a single detonator 720 of which the serial ID is known. This command also preferably sets the bus detection flag (conveyed by the respective data bit of the command word) high.

Operation—by Blasting Machine

After some or all detonators 720 may have been thus processed by the logger, they are connected to the bus 718. A number of detonators 720 can be connected depending on the specifics of the system (e.g., up to a thousand or more in the particular embodiment described here). The operator then powers up the blasting machine 740, which initiates a check for the presence of incompatible detonators and leakage, and may preferably be prompted to enter a password to proceed. The logger is then connected to the blasting machine 740 and a command issued to transfer the logged information (i.e., hole number, serial ID, and delay time for all of the logged detonators), and the blasting machine 740 provides a confirmation when this information has been received. (Although used in the preferred embodiment, a logger need not be separately used to log detonators 720, and a system could be configured in which the blasting machine 740 logs the detonators 720, e.g., using Auto Bus Detection command or other means are used to convey the pertinent information to the blasting machine 740 and/or conduct any other functions that are typically associated with a logger such as the functions described above).

The blasting machine 740 may preferably be programmed to then require the operator to command a system diagnostic check before proceeding to arming the detonators 720, or to perform such a check automatically. This command causes the blasting machine 740 to check and perform diagnostics on each of the expected detonators 720, and report any errors, which must be resolved before firing can occur. The blasting machine 740 and/or ASICs 730 are also preferably programmed so that the operator can also program or change the delay for specific detonators 720 as desired.

The blasting machine 740 and/or ASICs 730 are preferably programmed to permit the operator to arm the detonators 720, i.e., issue the Charge command (and the ASICs 730 to receive this command) once there are no errors, which causes the charging of the firing capacitors 726. Similarly, the blasting machine 740 and/or ASICs 730 are preferably programmed to permit the operator to issue the Fire command (and the ASICs 730 to receive this command) once the firing capacitors 726 have been charged and calibrated. The blasting machine 740 and/or ASICs 730 are also preferably programmed so that if the Fire command is not issued within a set period (e.g., 100 s), the firing capacitors 726 are discharged and the operator must restart the sequence if it is wished to perform a firing.

The blasting machine 740 is also preferably programmed so that, upon arming, an arming indicator light(s) alights (e.g., red), and then, upon successful charging of the detonators 720, that light preferably changes color (e.g., to green) or another one-alights to indicate that the system is ready to fire. The blasting machine 740 is also preferably programmed so that the user must hold down separate arming and firing buttons together until firing or else the firing capacitors 726 are discharged and the operator must restart the sequence to perform firing.

The foregoing sequence can be beneficially accomplished with other commands noted above, preferred details of which are discussed below.

Auto Bus Detection

This command permits the blasting machine 740 to detect any unknown (i.e., unlogged) detonators 720 that are connected to the bus 718, forcing such detonators to respond with their serial ID, delay data, scratch data, and current status flag settings. The blasting machine 740 and ASIC 730 may preferably be configured and programmed so that this command is used as follows:

1. The blasting machine 740 broadcasts the Auto Bus Detection command packet on the bus 718. All detonators 720 receiving the command that have not previously been detected on the bus 718 (as indicated by their respective bus detection status flag settings) calculate a "clock" value that correlates to their serial IDs and/or delay time information, and then enter a wait state. The correlated clock value can, for example, be calculated from an 11-bit number derived from the CRC-8 of the combined serial ID and selected data bits (e.g., 8 bits) of the delay register word of the Auto Bus Detection command packet, so that adequate time is afforded between each possible clock value for the initiation of a response (including any delay as described below) from a corresponding detonator 720.
2. The blasting machine 740 then begins issuing a "clock" sequence on the bus 718 that continues (except when halted or aborted as described below) until it reaches a number that correlates to the highest possible detonator serial ID in the system (for example, using the 11-bit number described above, there may be 2,048 possible clock values). Time must be allowed between the end of the Auto Bus Detection command packet and issuance of a clock that correlates to the first possible serial ID, to permit calculation by the ASICs 730 of the clock values that correlate to their serial IDs. This can be accomplished by including a wait time (e.g., 10 μs in the embodiment described here) between the end of the detection command packet and the leading edge of the first transition of the clock. To enable current talkback (as described elsewhere herein), the bus 718 is preferably held low during this time, but it can alternately be held high.
3. When the clock value for a particular unlogged detonator 720 is reached, the ASIC 730 of that detonator 720 responds. In the embodiment described here, time (during which the bus 718 is held high or low, preferably low) is permitted for the initiation of a response that is delayed by a predetermined period as shown in FIG. 15. The system may preferably be configured so that if the bus 718 is not pulled low before a predetermined timeout period (e.g., 4.096 ms), the detection process will abort.
4. Upon sensing a response from one or more detonators 720, the blasting machine 740 halts the clock sequence and holds the bus (preferably low) until the full response packet is received, at which point the clock sequence resumes. Alternately, adequate time for the transmission of a full packet could be permitted between the counting of each clock value that correlates to a possible serial ID, however, this would be slower. The blasting machine 740 records at least the serial ID (and optionally also the device settings) of any responding detonators 720. If more than one ASIC 730 begins responding simultaneously, the blasting machine 740 preferably ignores such responses and preferably resumes the clock sequence as it would otherwise.
5. The process starting with the Auto Bus Detection command packet is then repeated using a different delay time or a different dummy serial ID until no unlogged detonators 720 respond (i.e., until a full clock sequence is counted out without any devices responding), at which point it is deemed that all detonators 720 connected to the bus 718 are identified.

6. When the autobus detection sequence is complete, the blasting machine 740 then sends (in any desired order such as by serial ID) the Known Detonator Read Back command (described immediately below) to each individual known detonator 720, i.e., all those that responded to the Auto Bus Detection command, as well as all those that were initially identified to the blasting machine 740 by the logger.

Known Detonator Read Back

By this command, the blasting machine 740 or logger requests a read back of a single detonator 720 of which the serial ID is known. In response to this command, the detonator 720 provides its serial ID, delay time, scratch information, and status flags (notably including its charge status). This command preferably sets the bus detection flag high so that the device no longer responds to an Auto Bus Detection command.

Check Continuity

The system should be configured so that this command is required to be issued before the Charge command (described immediately below) can be issued. By this command, the blasting machine 740 broadcasts a request to all detonators 720 connected to the bus 718 to perform a continuity check. In response, each ASIC 730 in the detonators 720 performs a continuity check on the bridgewire 727 such as is described above with respect to the Single Check Continuity command sent to a specific detonator 720.

Charge

By this command, the blasting machine 740 requests a charge of all detonators 720 connected to the bus 718. After charging of each detonator 720, its charge status flag is set high. The detonators 720 respond back to the blasting machine 740 only if an error has occurred (e.g., a CRC error, the bus detection flag is not high, or—if staggered charging as described below is used—the scratch register is set to zero), in which case the response includes the corresponding error code.

If a large number of detonators 720 are connected to the bus 718, charging may preferably be staggered so that the detonators 720 are each charged at different times such as by the following steps:

1. The blasting machine 740 broadcasts the Charge command on the bus 718.
2. The blasting machine 740 then begins issuing a clock sequence at a selected temporal frequency on the bus 718, which sequence continues up to a certain maximum number corresponding to the maximum number of the scratch register, e.g., 4,096.
3. When the number of clocks reaches a number programmed in the scratch register of a particular detonator 720, that detonator 720 charges. The detonators 720 can have unique scratch values or they can be grouped by scratch number into banks (of e.g., 2 to 100) that thus charge concurrently. The clock frequency should be timed and the detonator scratch values set sequentially in such a way as to ensure that a desired minimum individual (i.e., non-overlapping) charging time is afforded to each detonator 720 or bank of detonators 720, which can be done in a number of ways (e.g., using scratch numbers of 1, 2, 3 . . . at a given clock frequency has the same effect as scratch numbers of 2, 4, 6 . . . at a clock frequency that is twice as fast). When the clock corresponding to the detonator 720 is received, the ASIC 730 begins charging the firing capacitor 726 (see, e.g., FIG. 11) until the capacitor voltage reaches a predefined charged threshold, at which point charge-topping of the firing capacitor 726 is then maintained.
4. If the capacitor voltage threshold is not achieved within a specified desired window (e.g., in the present embodiment, between 1.048 s and 8.39 s after the ASIC 730 begins charging the firing capacitor 726), then the ASIC 730 times out and sets the charge status flag to low (but does not need to be programmed to send a response communicating the error at this time, assuming that the Verify Charge command described below is used).
5. The charge process ends when the bus 718 is held low for more than a predetermined timeout period, e.g., 4.096 ms.

The minimum time required to charge a network of detonators in a staggered fashion thus essentially equals the desired individual (or bank) capacitor charging time (which in turn depends on the particular charging process used and the size of the firing capacitor 726) multiplied by the number of detonators 720 (or banks). For example, in the present embodiment, about 3 s per capacitor may be desirable with a system including 100 detonators or detonator banks in which the constant-current regulation process described below is employed, and results in an overall charging time of 300 s. Alternatively, the charge clocking can be controlled over a wide range of scratch values, e.g., clocking to a certain number of pulses (where all detonators with scratch values up to this pulse number will charge), pausing the clocking momentarily to allow these detonators to adequately charge to full capacity before issuing further clock pulses, pausing and resuming again if desired, and so on.

Figure 18:
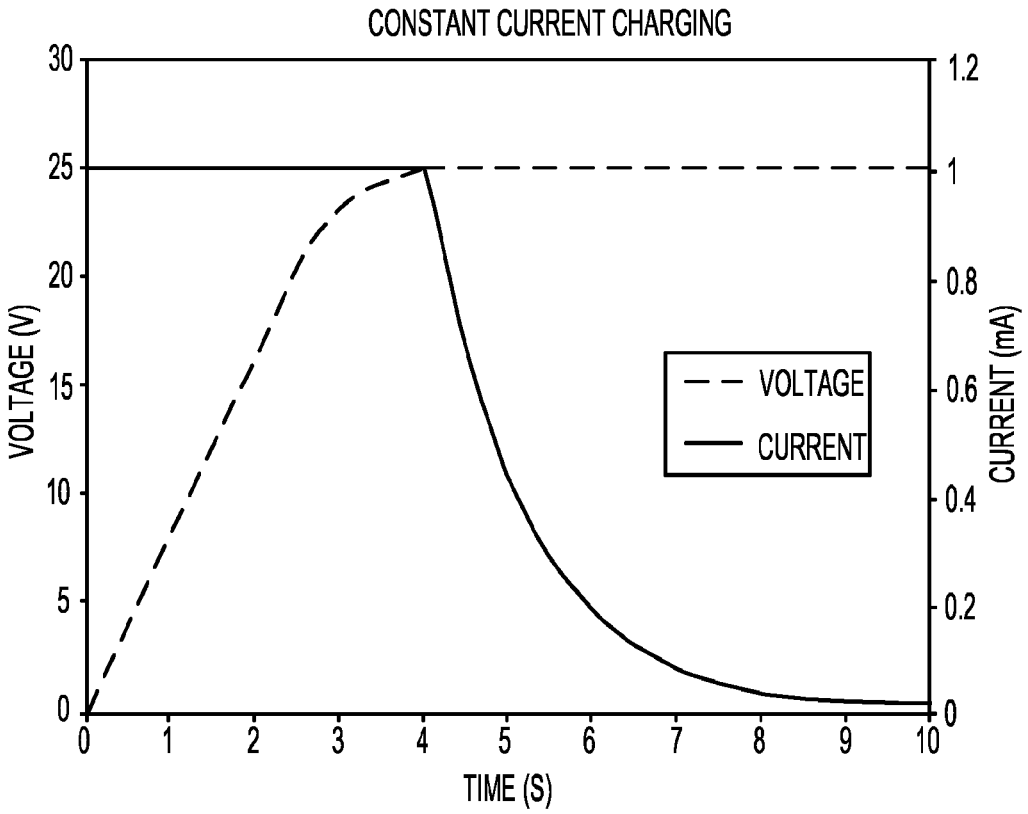
FIG. 18 is a graph of voltage and current versus time in a firing capacitor in a detonator such as that of FIG. 9, showing a constant-current, rail-voltage regulated charging process.

At the device level, the electricity supplied to each firing capacitor 726 during charging may preferably be through a constant-current, rail-voltage regulated charging process, as is shown in FIG. 18. In such a charging process, the current draw is held constant at a relatively low amount (e.g., at 1 mA) while voltage increases linearly with time until a "rail-voltage" (which is the regulator voltage, which is in turn suitably chosen together with the capacitance of the firing capacitor 726 and the firing energy of the bridgewire 727) is reached, after which the voltage remains constant at the rail voltage and the current draw thus decreases rapidly. Such charging regulation, which is known for example in the field of laptop computer battery chargers, may be accomplished by several methods such as a current-mirror using two bipolar transistors or MOSFETs, a fixed gate-source voltage on a JFET or MOSFET, or a current feedback using an op amp or comparator.

Charge Verify

By this command, the blasting machine 740 broadcasts a request to all detonators 720 on the bus 718 to verify that they are charged. If an ASIC 730 did not charge (as reflected by a low charge status flag setting per the charge procedure described above) or has a CRC error, it immediately responds back with the appropriate error code and other information including its status flags. The Charge Verify command can also effectively provide a verification of the proper capacitance of the firing capacitor 726 if a charging window time as described above with reference to the charging process is employed, and its limits are respectively defined to correspond to the time required (using the selected charging process) to charge a firing capacitor 726 having the upper and lower limits of acceptable capacitance. For example, in the embodiment described here, using a constant-current (1 mA), rail-voltage limited charging, a 47

μF capacitor nominally charges to 25V in 1.2 s, and a window of from 0.5 to 3 s corresponds to acceptable maximum/minimum capacitance limits (i.e., about 20 to 100 μF), or a 374 μF capacitor nominally charges to 25V in 9.4 s, and a window of from 6.25 to 12.5 s corresponds to acceptable maximum/minimum capacitance limits (i.e., about 250 to 500 μF). If the blasting machine 740 receives an error message in response to this command, it can re-broadcast the Charge command and terminate the sequence, or alternately it could be configured and programmed to permit the individual diagnosing and individual charging of any specific detonators 720 responding with errors.

Calibrate

Each one of detonators 720 contains an internal oscillator (see FIG. 11), which is used to control and measure duration of any delays or time periods generated or received by the detonator 720. The exact oscillator frequency of a given detonator 720 is not known and varies with temperature. In order to obtain repeatable and accurate blast timing, this variation must be compensated for. In the present embodiment this is accomplished by requesting the detonator 720 to measure (in terms of its own oscillator frequency) the duration of a fixed calibration pulse, NOM (preferably, e.g., 0.5 to 5 s in an embodiment such as that described here), which is generated by the blasting machine 740 using its internal oscillator as reference. In the present embodiment, the detonator 720 then uses the measured pulse duration, CC, to compute the firing delay in terms of the oscillator counts using the following formula: counts=DLY*(CC/NOM) where DLY is the value of the delay register. (In the present embodiment it is assumed that the temperature of the detonator 720 has become stable or is changing insignificantly by the time the actual blast is performed).

By the Calibrate command (the address bytes of which may contain any arbitrary data), the blasting machine 740 broadcasts a request to calibrate all detonators 720 on the bus 718. A detonator 720 responds back to the calibrate command only if an error has occurred (e.g., a CRC error or the bus detection or charge status flags are not high), in which case the response includes the corresponding error code. If there is no error, immediately after the calibration packet has been received, the detonator 720 waits until the bus 718 is pulled high for a set period (e.g., the same period described above as NOM), at which point the ASIC 730 begins counting at its oscillating frequency until the bus 718 is pulled back low to end the calibration sequence. The number of counts counted out by the ASIC 730 during this set period is then stored in the detonator's calibration register (and is later used by the ASIC 730 to determine countdown values) and the calibration flag is set high. Pulling the bus 718 low ends the Calibrate command sequence, and the rising edge of the next transition to high on the bus 718 is then recognized as the start of a new command.

Calibrate Verify

By this command, the blasting machine 740 broadcasts a request to verify calibration of all detonators 720 on the bus 718. In response, each detonator 720 checks that the value in its calibration register is within a certain range (e.g., in the embodiment described here, +/−40%) of a value corresponding to the ideal or nominal number of oscillator cycles that would occur during the period NOM. A detonator 720 responds back only if the calibration value is out of range or another error has occurred (e.g., a CRC error or the bus detection, charge, or calibrate status flags are not high), in which case the response includes the corresponding error code.

Fire

Figure 16A:
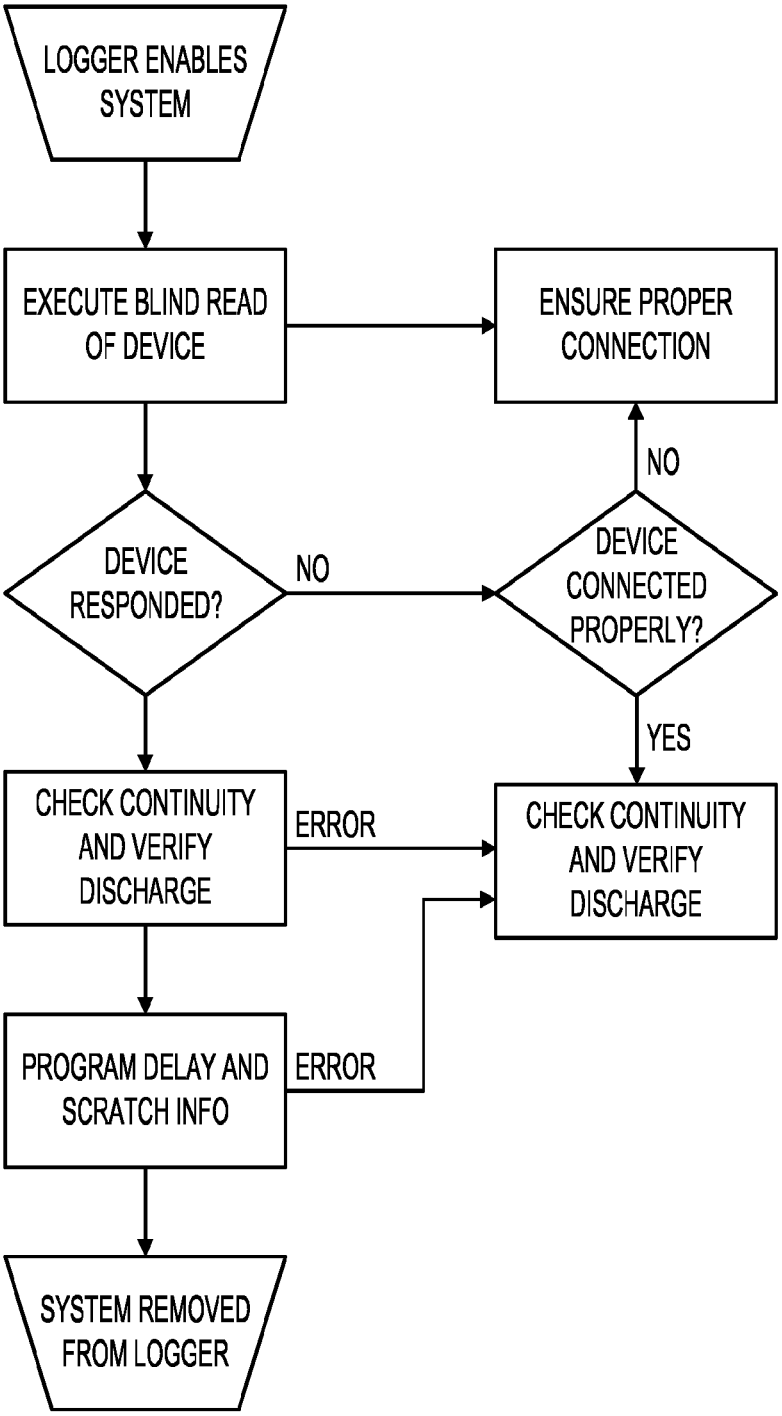
FIGS. 16*a*, 16*b*, 16*c*, and 16*d* are a flowchart illustrating a preferred logic sequence for the operation of an electronic blasting system of FIGS. 7 and 8.
Figure 16B:
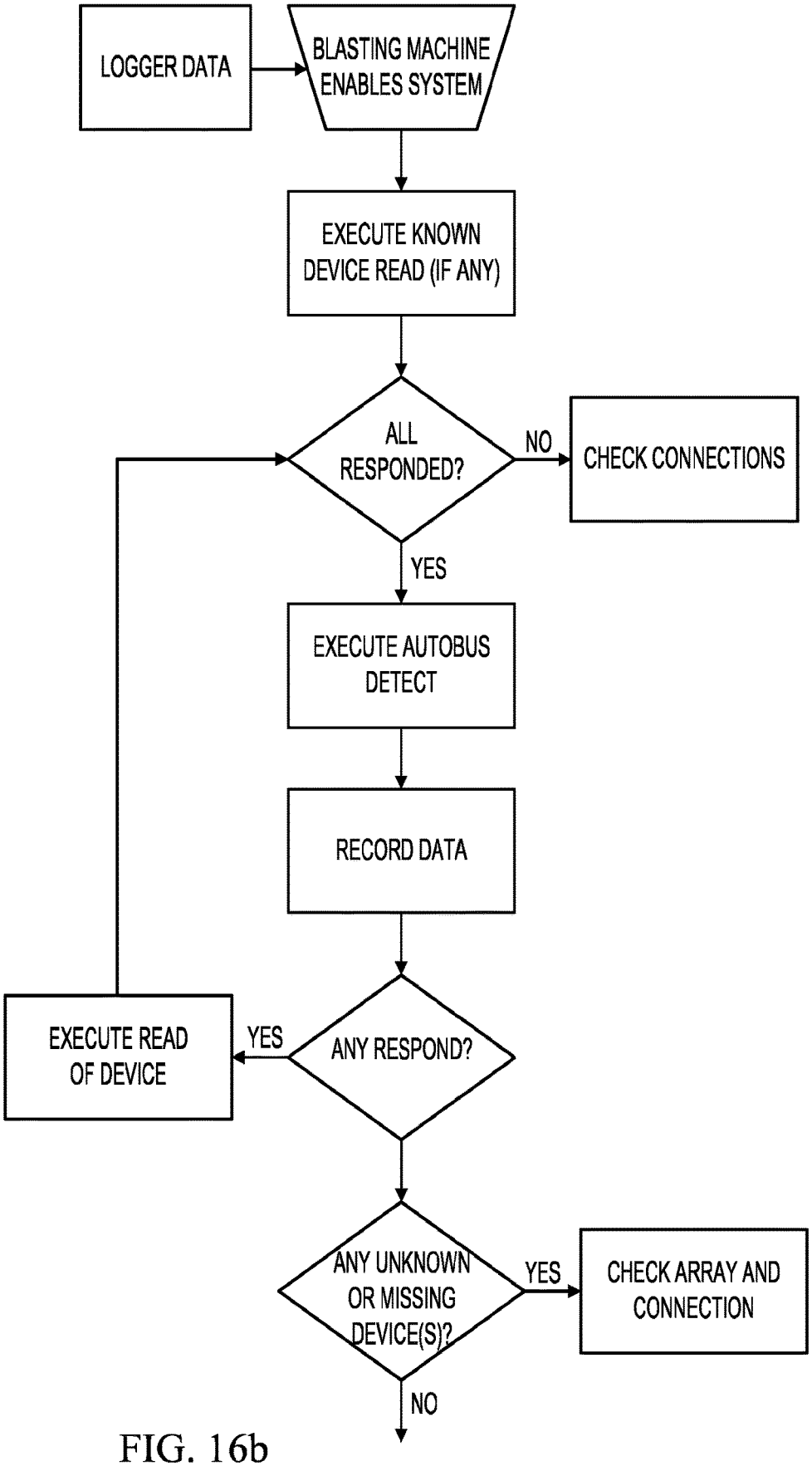
Figure 16C:
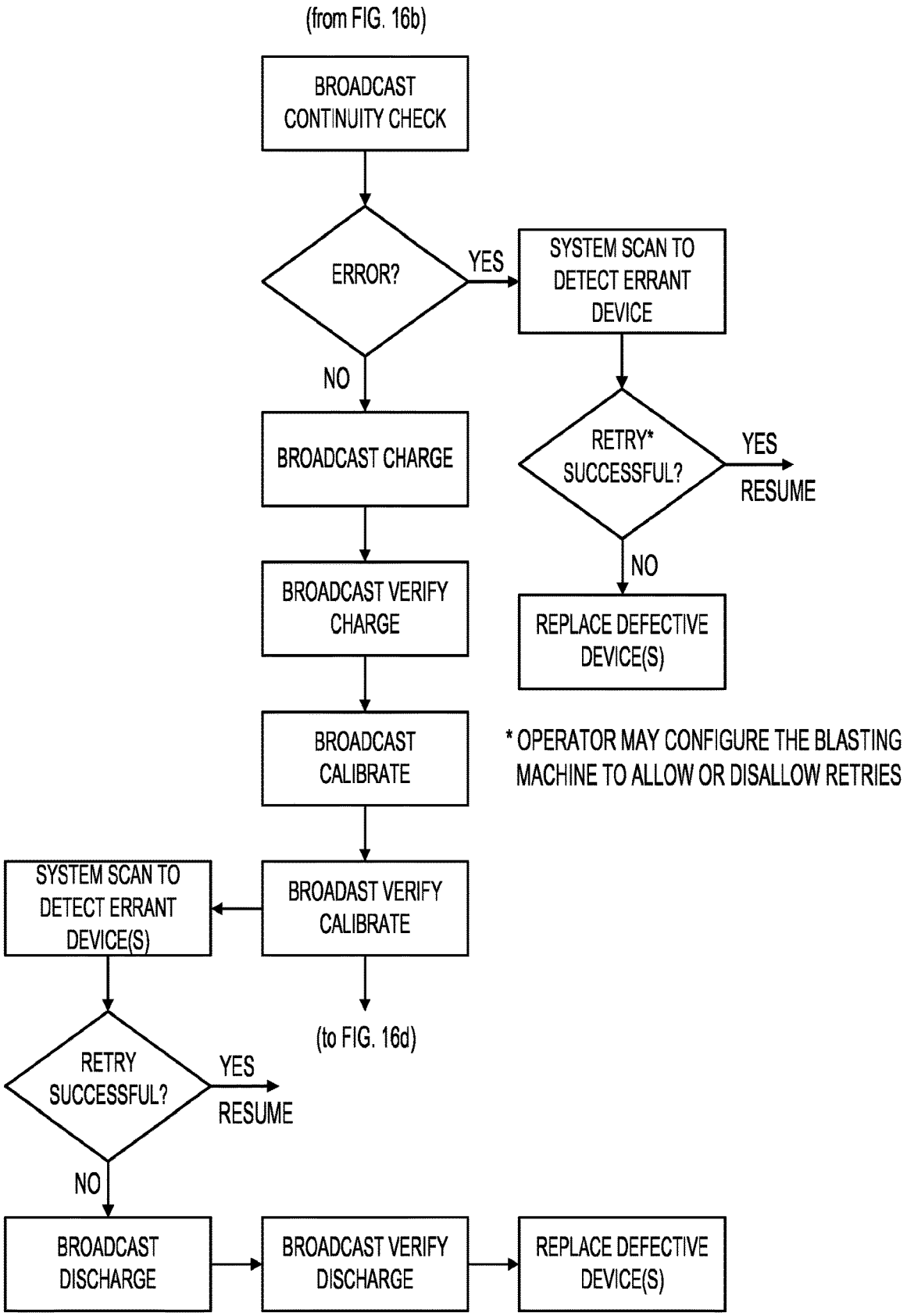
Figure 16D:
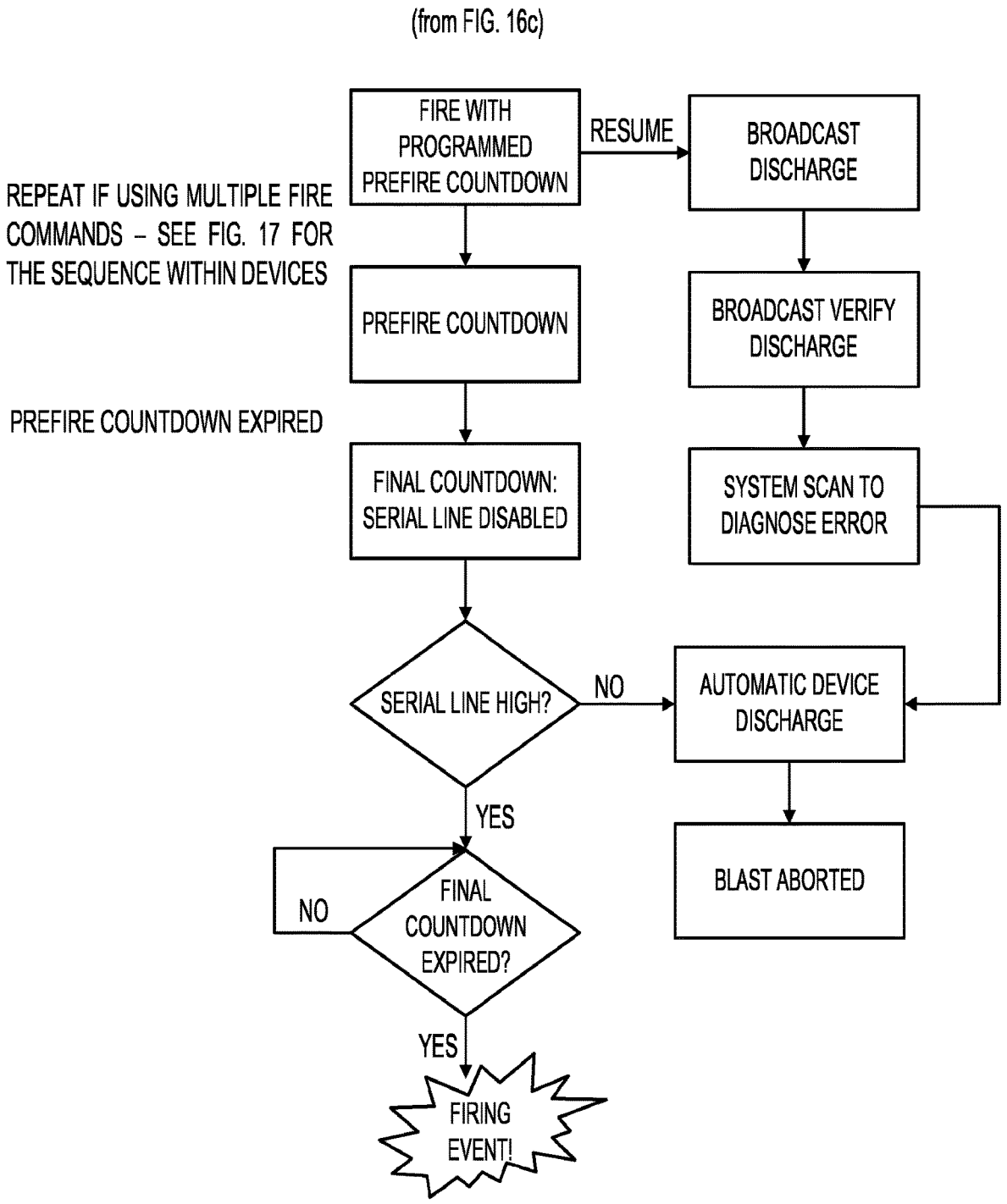
Figure 17:
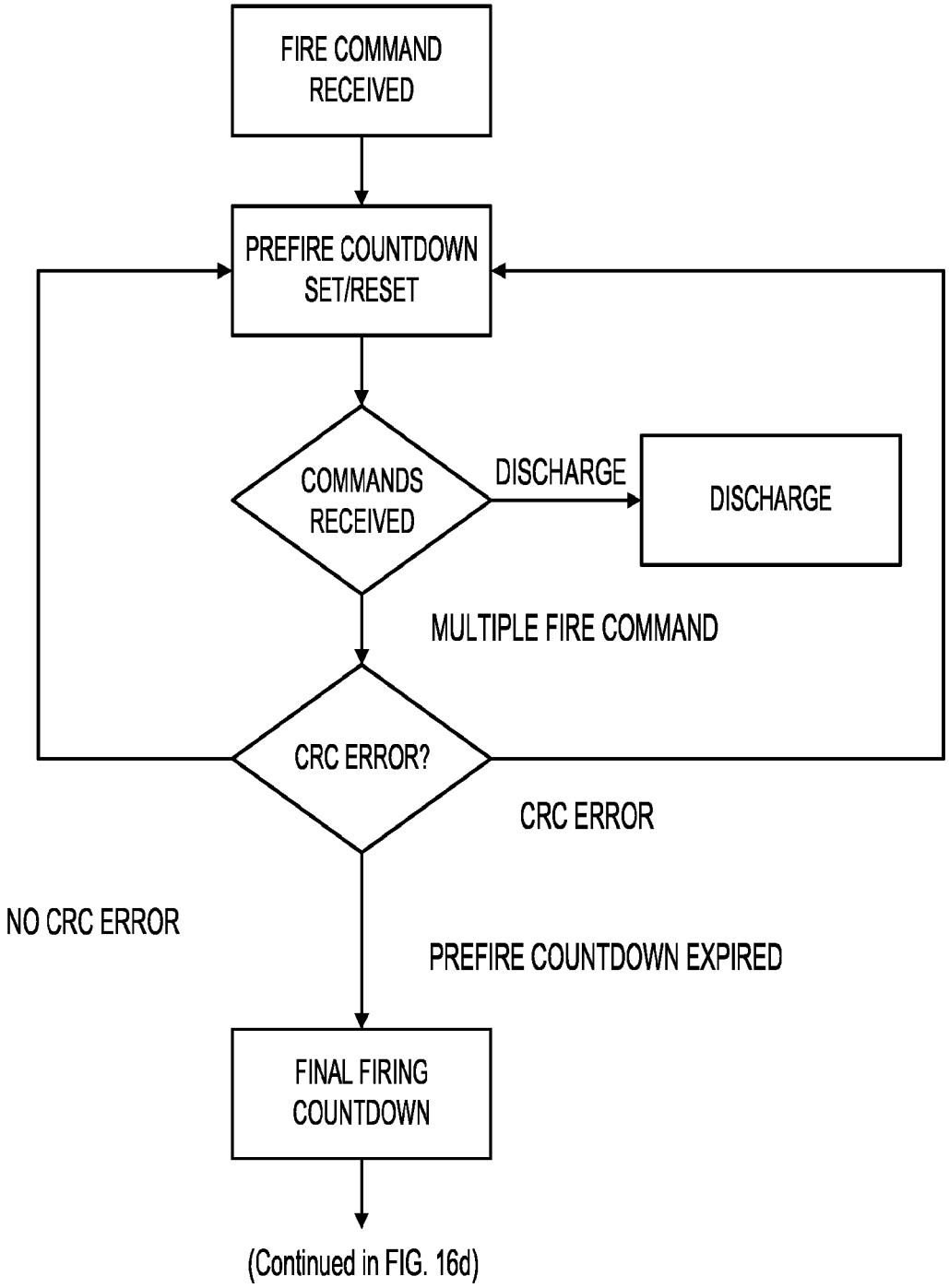
FIG. 17 is a flowchart illustrating a preferred logic sequence for the operation of a detonator that may be used in the electronic blasting system of FIGS. 7 and 8, beginning with the reception by the detonator of a Fire command.

By this command, the blasting machine 740 broadcasts a request to fire all detonators 720 on the bus 718. A detonator 720 responds back to this command only if an error has occurred (e.g., a CRC error, the bus detection, charge, or calibrate status flags are not high, or the delay register is set to zero), in which case the response includes the corresponding error code. Otherwise, in response to this command, the ASIC 730 of each detonator 720 initiates a countdown/fire sequence and sets the fire flag high. The blasting machine 740 and logger and/or ASIC 730 may beneficially be configured and programmed such that this process is as follows (see also FIG. 17):

1. Upon receipt of the Fire command, if there are CRC or procedural errors and the ASIC 730 has not yet successfully received a Fire command, then the device answers back immediately with the appropriate error code. (In which case, as shown in FIG. 16*d*, the blasting machine 740 preferably responds by broadcasting a Discharge command to all detonators 720; alternately, it could be designed to permit the individual diagnosis and correction of any detonators 720 responding with an error, or it can issue further Fire commands as noted in step 3 below). If there are no errors, then the ASIC 730 enters a "pre-fire countdown," the delay time for which is programmed by delay information of the packet that conveys the Fire command. For example, two bits of a delay register byte can correspond to four different pre-fire countdown delays that are based on the preceding calibration sequence and shifting, e.g., with a value of 1-1 corresponds to a 4.096 s delay, 1-0 to a 2.048 s delay, 0-1 to a 1.024 s delay, and 0-0 to a 0.512 s delay.
2. At any time during the counting down of the pre-fire countdown, the detonator 720 can receive a Single Discharge or Discharge command, or another Fire command. If the Fire command is sent again, then the ASIC 730 verifies there are no CRC errors. If there is a CRC error, then the new Fire command is ignored and the existing pre-fire countdown continues to progress. If there are no CRC errors, then the ASIC 730 resets its pre-fire countdown value to the value determined by the delay register of the new Fire command packet, and starts a new pre-fire countdown based on the new delay value. Depending on the initial pre-fire countdown delay value, it may be possible, and is preferred, to send the Fire command several (in the embodiment described here, three) additional times prior to the expiration of the pre-fire countdown.
3. If neither Discharge command is sent before expiration of the pre-fire countdown, the ASIC 730 checks that the bus 718 voltage exceeds a minimum absolute threshold value. If it does not, then the detonator 720 automatically discharges; otherwise, a "final fire countdown" begins and the communication interface of the detonator 720 is preferably disabled so that no further commands can be received. The final fire countdown time is preferably determined based on the calibration described above and a delay value programmed into a delay register in the ASIC 730. At the conclusion of the countdown of this final fire countdown time, the ASIC 730 causes the firing capacitor 726 to be discharged through bridgewire 727, resulting in detonation.

It has been found that a system constructed according to the preferred specifics described here, with up to a thousand or more detonators 720 networked to the blasting machine 740, can reliably provide a timing delay accuracy of better than 80 ppm (e.g., 0.8 ms with 10 s delay).

Discharge

By this command, the blasting machine 740 broadcasts a request to discharge all detonators 720 on the bus 718. A detonator 720 responds back to this command only if a CRC error has occurred in which case the response includes the corresponding error code (the discharge command is not performed in this case). Otherwise, in response to this command, the ASIC 730 of each detonator 720 stops any fire countdown that may be in progress, and causes the firing capacitor 726 to be discharged.

Discharge Verify

By this command, the blasting machine 740 broadcasts a request to verify the discharging of all detonators 720 on the bus 718. In response, the ASIC 730 of each detonator 720 verifies that the firing capacitor 726 is discharged, responding back only if a CRC or verification error has occurred (e.g., a CRC error or the bus detection, charge, or calibrate status flags are not high), in which case the response includes the corresponding error code.

Single Discharge

This command is the same as the Discharge command discussed above except that it requires a correct serial ID of a specific detonator 720 on the bus 718, which detonator responds back with its serial ID, delay and scratch information, status flags, and any error codes.

The particular system described here is subject to numerous additions and modifications. For example, not all of the commands described above would necessarily be required, they could be combined, separated, and otherwise modified in many ways, and numerous additional commands could be implemented. As some of many examples, a command could implemented to clear all bus detection flags of detonators 720 on the bus 718, to permit resetting of the bus detection process, a command could be implemented to permit individual charge and/or charge verify of selected detonators 720, etc. Further, other synchronization schemes (e.g., using a third clock line instead of dynamic synchronization) and/or protocols could be used if suitable for a particular application.

The example embodiments have been described with reference to the preferred embodiments. Modifications and alterations will occur to others upon reading and understanding the preceding detailed description. It is intended that the exemplary embodiment be construed as including all such modifications and alterations insofar as they come within the scope of the appended claims or the equivalents thereof. The above examples are merely illustrative of several possible embodiments of various aspects of the present disclosure, wherein equivalent alterations and/or modifications will occur to others skilled in the art upon reading and understanding this specification and the annexed drawings. In particular regard to the various functions performed by the above described components (assemblies, devices, systems, circuits, and the like), the terms (including a reference to a "means") used to describe such components are intended to correspond, unless otherwise indicated, to any component, such as hardware, processor-executed software and/or firmware, or combinations thereof, which performs the specified function of the described component (i.e., that is functionally equivalent), even though not structurally equivalent to the disclosed structure which performs the function in the illustrated implementations of the disclosure. In addition, although a feature of the disclosure may have been disclosed with respect to only one of several implementations, such feature may be combined with one or more other features of the other implementations as may be desired and advantageous for any given or particular application. Also, to the extent that the terms "including", "includes", "having", "has", "with", or variants thereof are used in the detailed description and/or in the claims, such terms are intended to be inclusive in a manner similar to the term "comprising."

The following is claimed:

1. A blasting system, comprising:

a master controller coupled to a bus, the master controller storing a mapping of local IDs and respective detonator global unique serial ID numbers for a plurality of individual detonators; and an integer number M electronic detonators of the plurality of individual detonators coupled to the bus, the M electronic detonators having a memory that stores a respective one of the local IDs;

the master controller configured to send a voltage signal that represents a command or communications request to the bus, and subsequently send an integer number N voltage clock pulses to the bus, N being an integer greater than M; and each respective detonator of the M electronic detonators configured to: responsive to said each respective detonator detecting the command or communications request from the master controller, respond to the command or communications request by asynchronously sending one or more current pulses to the bus a predetermined time delay after receipt of the command or communication request and responsive to an ith one of the N voltage clock pulses, the ith one being an integer that uniquely corresponds to a local ID of the local IDs stored in said each respective detonator and stored in the mapping of the local IDs and the respective detonator global unique serial ID numbers in the master controller.

2. The blasting system of claim 1, wherein said each respective detonator is further configured to:

count the N voltage clock pulses following the command or communications request; and responsive to the count, matching the local ID stored in said each respective detonator, respond to the command or communications request by sending the one or more current pulses to the bus.

3. The blasting system of claim 1, wherein the command or communications request is a verify command.

4. A blasting system comprising:

a master controller coupled to a bus, the master controller storing a mapping of local IDs, respective detonator serial ID numbers, and respective detonator delay times for a plurality of individual detonators; and an integer number M electronic detonators of the plurality of individual detonators coupled to the bus, the M electronic detonators having a memory that stores a respective one of the local IDs and a respective one of the respective detonator delay times;

the master controller configured to send a voltage signal that represents a command or communications request to the bus; and each respective detonator of the M electronic detonators configured to:

responsive to said each respective detonator detecting the command or communications request from the master controller, respond to the command or communications request by asynchronously sending one or more current pulses to the bus a predetermined time delay after receipt of the command or communications request, the predetermined time delay based on at least one of the respective one of the local IDs and the respective one of the respective detonator delay times; and wherein the predetermined time delay is the respective one of the local IDs multiplied by a scaling factor.

5. The blasting system of claim 4, wherein the predetermined time delay is the respective one of the respective detonator delay times.

6. The blasting system of claim 4, wherein the predetermined time delay is the respective one of the respective detonator delay times multiplied by a scaling factor.

7. A blasting system comprising:

a master controller coupled to a bus, the master controller storing a mapping of local IDs, respective detonator serial ID numbers, and respective detonator delay times; and an integer number M electronic detonators coupled to the bus, the M electronic detonators having a memory that stores a respective one of the local IDs and a respective one of the respective detonator delay times;

the master controller configured to send a voltage signal that represents a command or communications request to the bus; and each respective detonator of the M electronic detonators configured to:

responsive to said each respective detonator detecting the command or communications request from the master controller, respond to the command or communications request by asynchronously sending one or more current pulses to the bus a predetermined time delay after receipt of the command or communications request, the predetermined time delay based on at least one of the respective one of the local IDs and the respective one of the respective detonator delay times.

* * * * *